US010457998B2

(12) United States Patent
Okonogi et al.

(10) Patent No.: US 10,457,998 B2
(45) Date of Patent: Oct. 29, 2019

(54) WIRE ROD FOR NON HEAT-TREATED MECHANICAL PART, STEEL WIRE FOR NON HEAT-TREATED MECHANICAL PART, AND NON HEAT-TREATED MECHANICAL PART

(71) Applicant: NIPPON STEEL & SUMITOMO METAL CORPORATION, Tokyo (JP)

(72) Inventors: Makoto Okonogi, Chiba (JP); Daisuke Hirakami, Kisarazu (JP); Tatsusei Tada, Muroran (JP)

(73) Assignee: NIPPON STEEL CORPORATION, Tokyo (JP)

( * ) Notice: Subject to any disclaimer, the term of this patent is extended or adjusted under 35 U.S.C. 154(b) by 262 days.

(21) Appl. No.: 15/546,063

(22) PCT Filed: Jan. 27, 2016

(86) PCT No.: PCT/JP2016/052351
§ 371 (c)(1),
(2) Date: Jul. 25, 2017

(87) PCT Pub. No.: WO2016/121820
PCT Pub. Date: Aug. 4, 2016

(65) Prior Publication Data

US 2018/0016658 A1 Jan. 18, 2018

(30) Foreign Application Priority Data

Jan. 27, 2015 (JP) ..... 2015-013385
Feb. 19, 2015 (JP) ..... 2015-030891

(51) Int. Cl.
*C22C 38/00* (2006.01)
*C21D 9/52* (2006.01)
(Continued)

(52) U.S. Cl.
CPC ..... *C21D 9/525* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2002/0179207 A1 12/2002 Koike et al.
2013/0133789 A1 5/2013 Okonogi et al.
(Continued)

FOREIGN PATENT DOCUMENTS

CN 103080353 A 5/2013
CN 103906853 A 7/2014
(Continued)

OTHER PUBLICATIONS

International Search Report (PCT/ISA/210) issued in PCT/JP2016/052351, dated May 10, 2016.
(Continued)

*Primary Examiner* — Adam Krupicka
(74) *Attorney, Agent, or Firm* — Birch, Stewart, Kolasch & Birch, LLP

(57) ABSTRACT

A steel wire for a non heat-treated mechanical part includes, as a chemical composition, by mass %, a predetermined amount of C, Si, Mn, Cr, Mo, Ti, Al, B, Nb, and V, and limited P, S, N, and O and a remainder of Fe and impurities; in which a structure includes, by volume %, a bainite of greater than or equal to 75×[C %]+25, and a remainder of one or more of a ferrite and a pearlite when an amount of C is set to [C %] by mass %; when an average aspect ratio of a bainite block in a second surface layer area of the steel wire is set as R1, the R1 is greater than or equal to 1.2; when an
(Continued)

average grain size of a bainite block in a third surface layer area of the steel wire is set to $P_{S3}$ μm, and an average grain size of a bainite block in a third center portion of the steel wire is set to $P_{C3}$ μm, the $P_{S3}$ satisfies Expression (c), and the $P_{S3}$ and the $P_{C3}$ satisfy Expression (d), a standard deviation of a grain size of the bainite block in the structure is less than or equal to 8.0 μm; and a tensile strength is in a range of 800 MPa to 1600 MPa, $$P_{S3} \leq 20/R1 \quad \text{(c)},$$

$$P_{S3}/P_{C3} \leq 0.95 \quad \text{(d)}.$$

19 Claims, 3 Drawing Sheets

(51) Int. Cl.

| | |
|---|---|
| ***C22C 38/38*** | (2006.01) |
| ***C21D 6/00*** | (2006.01) |
| ***C21D 8/06*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 8/065* (2013.01); *C22C 38/001* (2013.01); *C22C 38/002* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01)

(56) References Cited

U.S. PATENT DOCUMENTS

| | | | |
|---|---|---|---|
| 2014/0290806 | A1 | 10/2014 | Okonogi et al. |
| 2015/0069141 | A1 | 3/2015 | Ueda et al. |

FOREIGN PATENT DOCUMENTS

| | | | |
|---|---|---|---|
| CN | 104185690 | A | 12/2014 |
| JP | 2-166229 | A | 6/1990 |
| JP | 8-041537 | A | 2/1996 |
| JP | 11-315347 | A | 11/1999 |
| JP | 11-315349 | A | 11/1999 |
| JP | 2000-144306 | A | 5/2000 |
| JP | 2001-348618 | A | 12/2001 |
| JP | 2002-069579 | A | 3/2002 |
| JP | 2004-307929 | A | 11/2004 |
| JP | 2005-281860 | A | 11/2004 |
| JP | 2008-261027 | A | 10/2008 |
| JP | 2009-275252 | A | 11/2009 |
| WO | WO 2011/062012 | A1 | 5/2011 |
| WO | WO 2012/023483 | A1 | 2/2012 |
| WO | WO 2013/031640 | A1 | 3/2013 |
| WO | WO 2014/199919 | A1 | 12/2014 |

OTHER PUBLICATIONS

Office Action issued in Taiwanese Patent Application No. 105102524 dated Nov. 9, 2016.

Written Opinion (PCT/ISA/237) issued in PCT/JP2016/052351, dated May 10, 2016.

Extended European Search Report for corresponding European Application No. 16743423.2, dated Aug. 13, 2018.

Chinese Office Action and Search Report for counterpart Chinese Application No. 201680007086.8, dated May 30, 2018, with an English translation of the Search Report.

WIRE ROD FOR NON HEAT-TREATED MECHANICAL PART, STEEL WIRE FOR NON HEAT-TREATED MECHANICAL PART, AND NON HEAT-TREATED MECHANICAL PART

TECHNICAL FIELD OF THE INVENTION

A non heat-treated mechanical part having tensile strength in a range of 800 MPa to 1600 MPa is used for vehicle parts having a shaft shape such as a bolt, a torsion bar, and a stabilizer, or various industrial machines.

The present invention relates to the non heat-treated mechanical part, a steel wire for manufacturing the same, and a wire rod for manufacturing the steel wire.

Note that, the non heat-treated mechanical part of the present invention includes bolts for vehicles or buildings.

Hereinafter, the wire rod for non heat-treated mechanical part is simply referred to as a wire rod, the steel wire for non heat-treated mechanical part is simply referred to as a steel wire, and non heat-treated mechanical part is simply referred to as a mechanical part in some cases.

Priorities are claimed on Japanese Patent Application No. 2015-013385 filed on Jan. 27, 2015, and Japanese Patent Application No. 2015-030891 filed on Feb. 19, 2015, the contents of which are incorporated herein by reference.

RELATED ART

As parts of vehicles and various industrial machines, high strength mechanical part having tensile strength of greater than or equal to 800 MPa has been used for the purpose of weight reduction and miniaturization.

However, along with high-strengthening of the mechanical part, a hydrogen embrittlement phenomenon becomes remarkable.

The hydrogen embrittlement phenomenon means a phenomenon in which the mechanical part is broken by a stress smaller than the originally expected stress due to the influence of hydrogen infiltrating into the wire rod or the steel wire.

This hydrogen embrittlement phenomenon appears in various forms.

For example, in the bolts used for vehicles and buildings, delayed fractures may occur in some cases.

Here, the delayed fracture means a phenomenon in which in the case of bolts or the like, breaking suddenly occurs in the bolt after the lapse of time from the tightening.

In this regard, as disclosed in Patent Documents 1 to 7, various studies have been conducted in order to enhance hydrogen embrittlement resistance of the high strength mechanical part.

The high strength mechanical part is manufactured by using steel materials including alloy steel, which is obtained by adding alloying elements such as Mn, Cr, Mo, and B to carbon steel for machine structural use, and special steel.

Specifically, first, the steel material of the alloy steel is subjected to hot rolling, then spheroidizing and softening. Then, the softened steel material is formed in a predetermined shape by cold forging or rolling. In addition, after forming the shape, a quenching treatment and a tempering treatment is performed so as to apply the tensile strength.

Further, regarding the bolt which is an example of the high strength mechanical part, a technique of using pearlite on which drawing is performed has been known as one of techniques of enhancing the delayed fracture resistance properties.

However, when the above-described steel material has a large amount of alloying elements, the steel material price is expensive.

Further, it is necessary to perform the softening annealing before forming the steel into a part shape, and the quenching treatment and the tempering treatment after forming, and thus the manufacturing cost is increased.

In order to solve such a problem, a wire rod in which the tensile strength is enhanced by rapid cooling and precipitation strengthening without performing the softening annealing, the quenching treatment and the tempering treatment has been known.

In addition, a technique of applying a predetermined tensile strength by subjecting drawing to the wire rod has been known.

Such a technique is used for a bolt or the like, and the bolt manufactured by using this technique is called a non heat-treated bolt.

Patent Document 8 discloses a method of manufacturing a non heat-treated bolt having a bainite structure in which steel containing, by mass %, C: 0.03% to 0.20%, Si: less than or equal to 0.10%, Mn: 0.70% to 2.5%, a total amount of one or two or more of V, Nb, and Ti: 0.05% to 0.30%, and B: 0.0005% to 0.0050% is cooled at a cooling rate of greater than or equal to 5° C./s after rolling the wire rod.

In addition, Patent Document 9 discloses a method of manufacturing a high strength bolt in which steel containing C: 0.05% to 0.20%, Si: 0.01% to 1.0%, Mn: 1.0% to 2.0%, S: less than or equal to 0.015%, Al: 0.01% to 0.05%, and V: 0.05% to 0.3% is heated at a temperature range of 900° C. to 1150° C., is hot-rolled, after finish rolling, is cooled down to a temperature range of 800° C. to 500° C. at an average cooling rate of greater than or equal to 2° C./s so as to realize a ferrite+bainite structure, and then is annealed at a temperature range of 550° C. to 700° C.

In the above-described manufacturing methods, it is necessary to strictly control the cooling rate and the cooling end temperature, and thus the manufacturing method becomes complicated.

In addition, there is a case where the structures are inhomogeneous, and thus cold forgeability is deteriorated.

Patent Document 10 discloses steel for cold forging, which contains, by mass %, C: 0.4% to 1.0%, and the chemical composition satisfies a specific conditional expression, and of which a structure consists of pearlite or pseudo-pearlite.

However, the steel contains coarse cementite having a lamellar shape, and thus is deteriorated in cold forgeability as compared with carbon steel for machine structural use such as a bolt used for the mechanical part or alloy steel for machine structural use in the related art.

As described above, in the non heat-treated wire rod manufactured by the technique in the related art, it is not possible to obtain a mechanical part having excellent cold forgeability by the manufacturing method at low cost.

Moreover, in the technique of the related art, it is not possible to obtain a steel wire and a wire rod for manufacturing the mechanical part.

In addition, in the above-described techniques of the related art, since the structure mainly includes pearlite which does not contain bainite or pseudo-pearlite, the tensile strength of the steel wire is enhanced, and thus deformation resistance is enhanced at the time of cold working, and a load of die is increased. Alternatively, even in a structure including bainite, a grain size of a bainite block or standard deviation are large, and thus ductility is deteriorated, cracking are likely to occur, and the cold workability is remarkable deteriorated.

For this reason, in the non heat-treated high-strength mechanical part which has tensile strength of greater than or equal to 800 MPa, and particularly, has tensile strength of greater than or equal to 1200 MPa, it is difficult to obtain excellent hydrogen embrittlement resistance.

PRIOR ART DOCUMENT

Patent Document

[Patent Document 1] Japanese Unexamined Patent Application, First Publication No. 2005-281860

[Patent Document 2] Japanese Unexamined Patent Application, First Publication No. 2001-348618

[Patent Document 3] Japanese Unexamined Patent Application, First Publication No. 2004-307929

[Patent Document 4] Japanese Unexamined Patent Application, First Publication No. 2008-261027

[Patent Document 5] Japanese Unexamined Patent Application, First Publication No. H11-315349

[Patent Document 6] Japanese Unexamined Patent Application, First Publication No. 2002-69579

[Patent Document 7] Japanese Unexamined Patent Application, First Publication No. 2000-144306

[Patent Document 8] Japanese Unexamined Patent Application, First Publication No. H2-166229

[Patent Document 9] Japanese Unexamined Patent Application, First Publication No. H8-041537

[Patent Document 10] Japanese Unexamined Patent Application, First Publication No. 2000-144306

DISCLOSURE OF THE INVENTION

Problems to be Solved by the Invention

The present invention has been made in consideration of such circumstances in the related art and an object thereof is to provide (a) a high strength mechanical part which can be manufactured at low cost, and is excellent in hydrogen embrittlement resistance having tensile strength in a range of 800 MPa to 1600 MPa, and (b) a steel wire which is used for manufacturing the mechanical part, can be manufactured without a heat treatment such as softening annealing, the quenching treatment and the tempering treatment, and is excellent in cold workability, and a wire rod which is used for manufacturing the steel wire, and is excellent in drawability.

Means for Solving the Problem

In order to achieve the above-described object, the inventors have studied a relationship between a chemical composition and a structure of the wire rod and the steel wire for obtaining the high strength mechanical part which can be cold-forged without a softening heat treatment, and has tensile strength of greater than or equal to 800 MPa even when a treatment such as quenching and tempering is not performed.

The present invention was made based on the metallurgical knowledge obtained in these studies, and the summary thereof is as follows.

(1) According to one aspect of the present invention, there is provided a steel wire for a non heat-treated mechanical part, the steel wire includes, as a chemical composition, by mass %, C: 0.18% to 0.65%, Si: 0.05% to 1.5%, Mn: 0.50% to 2.0%, Cr: 0% to 1.50%, Mo: 0% to 0.50%, Ti: 0% to 0.050%, Al: 0% to 0.050%, B: 0% to 0.0050%, Nb: 0% to 0.050%, V: 0% to 0.20%, P: limited to less than or equal to 0.030%, S: limited to less than or equal to 0.030%, N: limited to less than or equal to 0.0050%, O: limited to less than or equal to 0.01%, and a remainder of Fe and impurities; in which a structure includes, by volume %, a bainite of greater than or equal to 75×[C %]+25, and a remainder of one or more of ferrite and pearlite when an amount of C is set to [C %] by mass %; when a diameter of the steel wire is set to $D_2$ mm, an area from a surface of the steel wire to a depth of $0.1\times D_2$ mm toward a center line of a cross section is set as a second surface layer area of the steel wire, and an average aspect ratio of a bainite block in the second surface layer area of the steel wire is set to R1 in the cross section parallel to a longitudinal direction of the steel wire, the R1 is greater than or equal to 1.2; when the diameter of the steel wire is set to $D_2$ mm, an area from a surface of the steel wire to a depth of $0.1\times D_2$ mm toward a center of a cross section is set as a third surface layer area of the steel wire, an area from the depth of $0.25\times D_2$ mm to the center of the cross section is set as a third center portion of the steel wire, an average grain size of a bainite block in the third surface layer area of the steel wire is set to $P_{S3}$ μm, and an average grain size of a bainite block in the third center portion of the steel wire is set to $P_{C3}$ μm in the cross section perpendicular to the longitudinal direction of the steel wire, the $P_{S3}$ satisfies Expression (C), and the $P_{S3}$ and the $P_{C3}$ satisfy Expression (D); a standard deviation of a grain size of the bainite block in the structure is less than or equal to 8.0 μm; and a tensile strength is in a range of 800 MPa to 1600 MPa.

$$P_{S3} \leq 20/R1 \quad \text{(C)}$$

$$P_{S3}/P_{C3} \leq 0.95 \quad \text{(D)}$$

(2) The steel wire for a non heat-treated mechanical part according to the above (1) may include, as the chemical composition, by mass %, C: 0.18% to 0.50%, and Si: 0.05% to 0.50%.

(3) The steel wire for a non heat-treated mechanical part according to the above (1) may include, as the chemical composition, by mass %, C: 0.20% to 0.65%, in which the structure may include, by volume %, the bainite of greater than or equal to 45×[C %]+50 when the amount of C is set to [C %] by mass %.

(4) The steel wire for a non heat-treated mechanical part according to any one of the above (1) to (3), may include, as the chemical composition, by mass %, B: less than 0.0005%, in which F1 obtained by Expression (B) may be greater than or equal to 2.0, when the amount of C is set to [C %], an amount of Si is set to [Si %], an amount of Mn is set to [Mn %], an amount of Cr is set to [Cr %], and an amount of Mo is set to [Mo %] by mass %.

$$F1=0.6\times[C\ \%]-0.1\times[Si\ \%]+1.4\times[Mn\ \%]+1.3\times[Cr\ \%]+3.7\times[Mo\ \%] \quad \text{(B)}$$

(5) In the steel wire for a non heat-treated mechanical part according to the above (1), the R1 may be less than or equal to 2.0.

(6) In the steel wire for a non heat-treatedmechanical part according to the above (1), the structure may include, by volume %, the bainite of greater than or equal to 45×[C %]+50.

(7) According to a second aspect of the present invention, there is provided a wire rod for a non heat-treated mechanical part for obtaining the steel wire for a non heat-treated mechanical part according to any one of the above (1) to (6), the wire rod includes, as a chemical composition, by mass %, C: 0.18% to 0.65%, Si: 0.05% to 1.5%, Mn: 0.50% to 2.0%, Cr: 0% to 1.50%, Mo: 0% to 0.50%, Ti: 0% to 0.050%, Al: 0% to 0.050%, B: 0% to 0.0050%, Nb: 0% to 0.050%, V: 0% to 0.20%, P: limited to less than or equal to 0.030%, S: limited to less than or equal to 0.030%, N: limited to less than or equal to 0.0050%, O: less than or equal to 0.01%, and a remainder of Fe and impurities; in which a structure includes, by volume %, a bainite of greater than or equal to 75×[C %]+25, and a remainder of one or more of a ferrite and a pearlite without a martensite when an amount of C is set to [C %] by mass %; an average grain size of a bainite block of the structure is in a range of 5.0 μm to 20.0 μm, and a standard deviation of a grain size of the bainite block is less than or equal to 15.0 μm; and when a diameter of the wire rod is set to $D_1$ mm, an area from a surface of the wire rod to a depth of $0.1\times D_1$ mm toward a center of a cross section is set as a first surface layer area of the wire rod, an area from the depth of $0.25\times D_1$ mm to the center of the cross section is set as a first center portion of the wire rod, an average grain size of a bainite block in the first surface layer area is $P_{S1}$ μm, and an average grain size of a bainite block in the first center portion is $P_{C1}$ μm in the cross section perpendicular to a longitudinal direction of the wire rod, the $P_{S1}$ and the $P_{C1}$ satisfy Expression (A).

$$P_{S1}/P_{C1}\leq 0.95 \quad \text{(A)}$$

(8) The wire rod for a non heat-treated mechanical part according to the above 7 may include, as the chemical composition, by mass %, C: 0.18% to 0.50%, and Si: 0.05% to 0.50%.

(9) The wire rod for a non heat-treated mechanical part according to the above 7 may include, as the chemical composition, by mass %, C: 0.20% to 0.65%, in which the structure includes, by volume %, the bainite of greater than or equal to 45×[C %]+50 when the amount of C is set to [C %] by mass %.

(10) According to a third aspect of the present invention, there is provided a non heat-treated mechanical part having a cylindrical axis, the mechanical part includes, as a chemical composition, by mass %, C: 0.18% to 0.65%, Si: 0.05% to 1.5%, Mn: 0.50% to 2.0%, Cr: 0% to 1.50%, Mo: 0% to 0.50%, Ti: 0% to 0.050%, Al: 0% to 0.050%, B: 0% to 0.0050%, Nb: 0% to 0.050%, V: 0% to 0.20%, P: limited to less than or equal to 0.030%, S: limited to less than or equal to 0.030%, N: limited to less than or equal to 0.0050%, O: limited to less than or equal to 0.01%, and a remainder of Fe and impurities; in which a structure includes, by volume %, a bainite of greater than or equal to 75×[C %]+25, and a remainder of one or more of a ferrite and a pearlite when an amount of C is set to [C %] by mass %; when a diameter of the axis is set to $D_3$ mm, an area from a surface of the axis to a depth of $0.1\times D_3$ mm toward a center line of a cross section is set as a fourth surface layer area of the mechanical part, and an average aspect ratio of a bainite block in the fourth surface layer area of the mechanical part is set to R2 in the cross section parallel to a longitudinal direction of the axis, the R2 is greater than or equal to 1.2; when the diameter of the axis is set to $D_3$ mm, an area from a surface of the axis to a depth of $0.1\times D_3$ mm toward a center of a cross section is set as a fifth surface layer area of the mechanical part, an area from the depth of $0.25\times D_3$ mm to the center of the cross section is set as a fifth center portion of the mechanical part, an average grain size of a bainite block in the fifth surface layer area of the mechanical part is set to $P_{S5}$ μm, and an average grain size of a bainite block in the fifth center portion of the mechanical part is set to $P_{C5}$ μm in the cross section perpendicular to the longitudinal direction of the axis, the $P_{S5}$ satisfies Expression (E), and the $P_{S5}$ and the $P_{C5}$ satisfy Expression (F); a standard deviation of a grain size of the bainite block in the structure is less than or equal to 8.0 μm; and a tensile strength is in a range of 800 MPa to 1600 MPa.

$$P_{S5}\leq 20/R2 \quad \text{(E)}$$

$$P_{S5}/P_{C5}\leq 0.95 \quad \text{(F)}$$

(11) The non heat-treated mechanical part according to the above 10 may be obtained by performing a cold working on the steel wire according to any one of the above 1 to 6.

(12) In the non heat-treated mechanical part according to the above 10 or 11, the R2 may be greater than or equal to 1.5, and the tensile strength may be in a range of 1200 MPa to 1600 MPa.

(13) In the non heat-treated mechanical part according to the above 10 or 11, the $D_2$ and the $D_3$ may be equivalent to each other.

(14) In the non heat-treated mechanical part according to any one of the above 10 to 13, the non heat-treated mechanical part may be a bolt.

Effects of the Invention

According to the present invention, it is possible to provide the high strength mechanical part having tensile strength in a range of 800 MPa to 1600 MPa, and the wire rod and the steel wire which are materials for the mechanical part at low cost.

In addition, the present invention can contribute to weight reduction and miniaturization of vehicle, various industrial machines, and construction parts, and the industrial contribution is extremely remarkable.

EMBODIMENTS OF THE INVENTION

Figure 1:
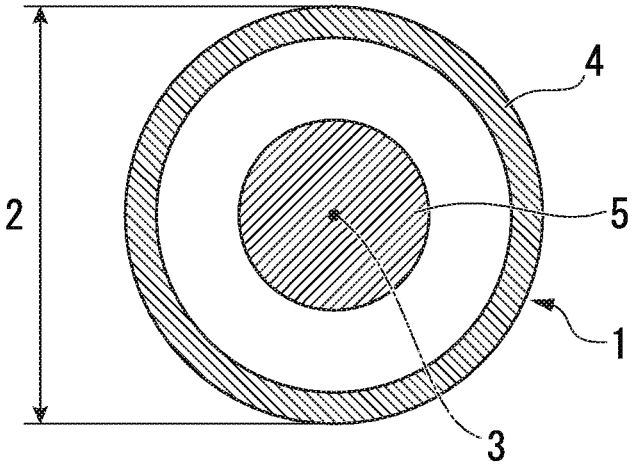
FIG. 1 is a diagram illustrating an area from a surface of a wire rod to a depth of $0.1D_1$ mm toward the center of a cross section, that is, a first surface layer area, and an area from a depth of $0.25D_1$ mm to the center of the cross section, that is, a first center portion, when a diameter of the wire rod is set to $D_1$ mm in the cross section perpendicular to a longitudinal direction of a wire rod for a non heat-treated mechanical part according to the second aspect of the present invention.

As described above, the inventors have studied a relationship between a chemical composition and a structure of a wire rod and steel wire, in which a steel wire is manufactured by using, as a material, the wire rod excellent in the drawability, then in a process of manufacturing a mechanical part from the steel wire, it is possible to perform cold forging without a softening heat treatment, and a mechanical part has tensile strength of greater than or equal to 800 MPa even when a treatment such as quenching and tempering is not performed after forming the mechanical part.

In addition, a non heat-treated mechanical part which is a target of the present invention is a mechanical part to which tensile strength is applied due to work hardening such as drawing or forging without performing a heat treatment such as softening annealing, a quenching treatment or a tempering treatment. Here, the non heat-treated mechanical part is assumed to be a mechanical part having a reduction area from an initial cross section of greater than or equal to 20%.

In addition, the present inventors have comprehensive studied on an in-line heat treatment using heat retained at the time of hot rolling of the wire rod and a series of manufacturing methods up to the steel wire and the mechanical part in order to manufacture the high strength mechanical part at low cost, and the studies have reached the conclusion of the followings (a) to (d) based on the metallurgical knowledge obtained in these studies.

(a) A steel wire obtained by drawing a wire rod becomes high-strengthening. However, in the high strengthen steel wire, workability is deteriorated, deformation resistance is high, and cracking is likely to occur.

(b) In order to improve the workability of the high strength steel wire, it is effective to control the volume percentage of the bainite of the steel wire, to reduce variation in the grain sizes of the bainite block, and to make the grain size of the bainite block in the surface layer area fine size.

(c) When an amount of C of the steel wire is set to [C %] by mass %, and a volume percentage of the bainite is set to $V_{B2}$ by volume %, $V_{B2}$ satisfies Expression 1, which is effective to improve cold workability of the steel wire.

$$V_{B2} \geq 75 \times [C\ \%] + 25 \quad \text{(Expression 1)}$$

(d) The cold workability of the steel wire can be remarkably improved by satisfying all of the followings (d-1) to (d-4).

(d-1) In a cross section parallel to a longitudinal direction of the steel wire, when a diameter of the steel wire is set to $D_2$ mm, in an area from the surface of the steel wire to a depth of $0.1D_2$ mm toward a center line of the steel wire, that is, in a second surface layer area of the steel wire, an average aspect ratio of bainite block is set to R1. R1 is set to greater than or equal to 1.2.

(d-2) In a cross section perpendicular to the longitudinal direction of the steel wire, in an area from the surface of the steel wire to a depth of $0.1D_2$ mm toward a center of the cross section, that is, in a third surface layer area of the steel wire, R1 and an average grain size of bainite block $P_{S3}$ satisfies Expression 2.

$$P_{S3} \leq 20/R1 \quad \text{(Expression 2)}$$

(d-3) The standard deviation of the grain size of the bainite block of the steel wire is less than or equal to 8.0 μm.

(d-4) In the cross section perpendicular to the longitudinal direction of the steel wire, when the diameter of the steel wire is set to $D_2$ mm, in an area from the depth of $0.25D_2$ mm to the center of the cross section, that is, in a third center portion, when an average grain size of bainite block is set to $P_{C3}$, $P_{C3}$ and the average grain size of the bainite block $P_{S3}$ in the third surface layer area satisfy Expression 3.

$$P_{S3}/P_{C3} \leq 0.95 \quad \text{(Expression 3)}$$

<Bainite Block>

Here, the bainite block will be described below in detail. Typically the bainite block is referred to as a structural unit consisting of bcc iron with well-oriented orientation.

The bainite block grain means an area in which the grain orientation of ferrite can be regarded as the same, and a boundary having an orientation difference of higher than or equal to 15° from a grain orientation map of the bcc structure is assumed to be a bainite block grain boundary.

In addition, the present inventors have studied a relationship between the chemical composition and the structure of the wire rod which is a material for obtaining the above-described steel wire.

In order to not only improve the drawability but also obtain a structure of the steel wire as the wire rod for obtaining the above-described steel wire, it is effective to control the volume percentage of the bainite, to reduce variation in the grain sizes of the bainite block, and to make the grain size of the bainite block in the surface layer area fine size. Specifically, it is possible to improve the drawability of the wire rod, and obtain the structure of the above-described steel wire by satisfying the followings (e-1) to (e-4).

Further, the finer the average grain size of the bainite block, the ductility of the wire rod is improved.

(e-1) The structure of the wire rod does not include martensite but includes bainite, ferrite, and pearlite.

(e-2) When the amount of C of the wire rod is set to [C %] by mass %, and the volume percentage of the bainite is set to $V_{B1}$ by volume %, $V_{B1}$ satisfies Expression 4, which is effective to improve cold workability of the steel wire.

$$V_{B1} \geq 75 \times [C\ \%] + 25 \quad \text{(Expression 4)}$$

(e-3) The average grain size of the bainite block of the wire rod is in a range of 5.0 μm to 20.0 μm, and the standard deviation of the bainite block is less than or equal to 15.0 μm.

(e-4) In the cross section perpendicular to the longitudinal direction of the wire rod, the diameter of the wire rod is set to $D_1$ mm, and the area from the surface of the wire rod to the depth of $0.1D_1$ mm toward the center of the cross section is set as the first surface layer area of the wire rod. In addition, the area from the depth of $0.25D_1$ mm to the center of the cross section is set as the first center portion. In addition, when the average grain size of the bainite block of the first surface layer area is set to $P_{S1}$, the average grain size of the bainite block of the first center portion is set to $P_{C1}$, $P_{S1}$ and $P_{C1}$ satisfy Expression 5.

$$P_{S1}/P_{C1} \leq 0.95 \quad \text{(Expression 5)}$$

Next, the present inventors have studied the mechanical part obtained by cold-forging the steel wire. Specifically, the inventors have studied the influence of the composition and the structure with respect to the hydrogen embrittlement resistance of the high strength mechanical part having the tensile strength which is greater than or equal to 800 MPa, and is particularly greater than or equal to 1200 MPa, and have found a composition and a structure for obtaining the excellent hydrogen embrittlement resistance.

In addition, as a result of extensive investigations based on metallurgical knowledge on methods for obtaining such chemical compositions and structures, the following matters were clarified.

In order to obtain the excellent hydrogen embrittlement resistance, it is effective to elongate the structure of the surface layer area of the mechanical part to the direction parallel to the surface.

The mechanical part of the present invention has a cylindrical axis.

Specifically, in L cross section which is the cross section parallel to the longitudinal direction of the axis, a diameter of the axis is set to $D_3$.

Figure 3A:
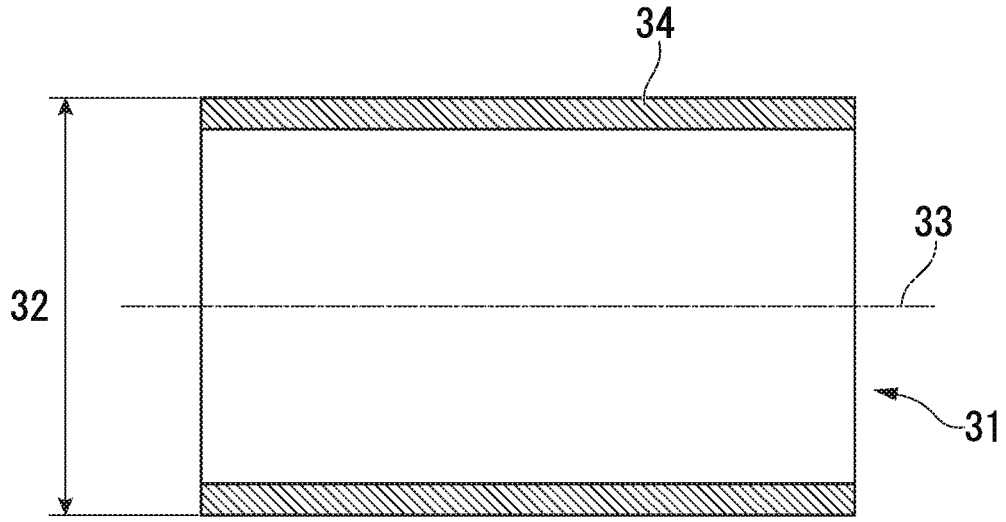
FIG. 3A is a diagram illustrating an area from a surface of an axis to a depth of $0.1D_3$ mm from a center line of a cross section, that is, a fourth surface layer area, when a diameter of the axis is set to $D_3$ mm in the cross section parallel to a longitudinal direction of a cylindrical axis of a non heat-treated mechanical part according to the third aspect of the present invention.
Figure 3B:
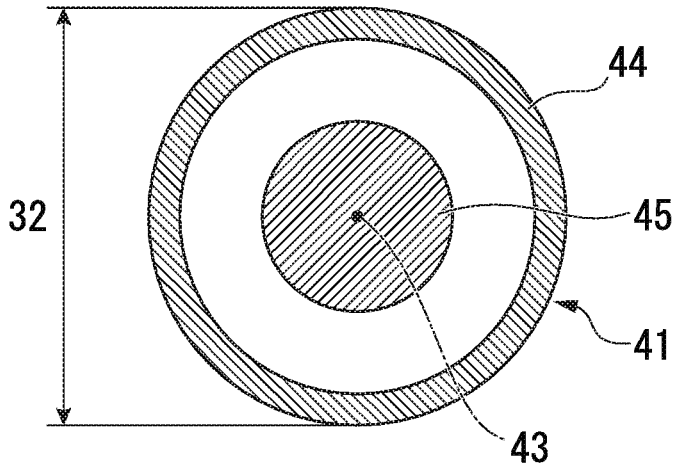
FIG. 3B is a diagram illustrating an area from the surface of the axis to a depth of $0.1D_3$ mm toward the center of the cross section, that is, a fifth surface layer area, and an area from a depth of $0.25D_3$ mm to the center of the cross section, that is, a fifth center portion, when a diameter of the axis is set to $D_3$ mm in the cross section perpendicular to a longitudinal direction of the cylindrical axis of the non heat-treated mechanical part according to the third aspect of the present invention.

In addition, as illustrated in FIG. 3A, in the mechanical part, when the average aspect ratio R2 of the bainite block in the area from the surface to the depth of 0.1 $D_3$, that is, in the fourth surface layer area is greater than or equal to 1.2, it is possible to improve the hydrogen embrittlement resistance of the mechanical part.

In other words, the bainite block which is not sufficiently elongated is less likely to contribute to the hydrogen embrittlement resistance, and thus it is preferable to elongate the bainite block.

Here, the aspect ratio R2 of the bainite block means a ratio indicated by the dimension of the major axis/the dimension of the minor axis of the bainite block.

Particularly, in the mechanical part, in a case where the tensile strength in a range of 1200 MPa to 1600 MPa is required, the average aspect ratio R2 of the bainite block in the fourth surface layer area is preferably set to greater than or equal to 1.5.

On the other hand, in the mechanical part, in a case where the tensile strength in a range of 800 MPa to 1200 MPa is obtained, the average aspect ratio R2 of the bainite block in the fourth surface layer area is preferably less than or equal to 2.0.

Further, when the mechanical part satisfies all of the followings (f) to (h), it is possible to obtain the non heat-treated mechanical part having the sufficient hydrogen embrittlement resistance without cracking.

(f) When an amount of C of the mechanical part is set to [C %], the volume percentage of the bainite $V_{B3}$, by volume %, satisfies Expression 6.

$$V_{B3} \geq 75 \times [\text{C \%}] + 25 \quad \text{(Expression 6)}$$

Particularly, in the mechanical part, in a case where the tensile strength in a range of 1200 MPa to 1600 MPa is required, a volume percentage of the bainite $V_{B3}$, by volume %, preferably satisfies Expression 7.

$$V_{B3} \geq 45 \times [\text{C \%}] + 50 \quad \text{(Expression 7)}$$

(g) In addition, when the average aspect ratio of the bainite block is set to R2, R2 is greater than or equal to 1.2, and in a fifth surface layer area of C cross section which is the cross section perpendicular to the longitudinal direction of the axis of the mechanical part, the average grain size of the bainite block $P_{S5}$, by unit μm, satisfies Expression 8.

$$P_{S5} \leq 20/R2 \quad \text{(Expression 8)}$$

(h) Further, the standard deviation of the grain size of the bainite block is set to less than or equal to 8.0 μm, and the average grain sizes $P_{S5}$ and $P_{C5}$ of the bainite block of the fifth surface layer area and the fifth center portion of the mechanical part satisfy Expression 9.

$$P_{S5}/P_{C5} \leq 0.95 \quad \text{(Expression 9)}$$

As such, when the chemical composition and the structure of the wire rod, the steel wire, and the mechanical part are improved, it is possible to obtain the wire rod which is excellent in the drawability, and the steel wire obtained by drawing the wire rod is excellent in the high strength and the cold workability. In addition, the mechanical part obtained by cold-forging the steel wire can be subjected to the high-strengthening without the quenching treatment and the tempering treatment, and it is possible to improve the hydrogen embrittlement resistance of the mechanical part.

In order to obtain the high strength mechanical part without the treatment such as quenching and tempering, it is effective to make the steel wire have a microstructure with the above-described features in advance at the stage of the steel wire as a material, and to process the steel wire into a part for machine structural use without performing the heat treatment before the processing.

In other words, when the steel wire according to the present embodiment is used, it is possible to perform the cold forging without a softening heat treatment.

That is, when the steel wire according to the present embodiment is used, it is possible to reduce the softening annealing cost for a spheroidizing and heating treatment (the softening heat treatment) of the steel wire, and the cost for the quenching treatment and the tempering treatment after forming the steel wire at the time of manufacturing the mechanical part, and thus it is advantageous from the aspect of the cost.

Further, the wire rod according to the present embodiment can be obtained by being rolled with residual heat at the time of the hot rolling, and then immediately immersed into a molten salt bath including two tanks. The steel wire according to the present embodiment is manufactured by drawing the wire rod according to the present embodiment in the cold rolling. With such a manufacturing method, it is possible to obtain the steel wire in which the volume percentage of the bainite is controlled without a large amount of expensive alloying elements added. Accordingly, the aforementioned manufacturing method is the best manufacturing method that can obtain excellent material properties at low cost.

That is, the non heat-treated mechanical part according to the present embodiment can be manufactured by using a series of manufacturing methods as described below.

First, the wire rod having a desired diameter, in which the chemical composition is adjusted so as to control the bainite, the hot rolling is performed, and winding and two-stage cooling are performed, is immersed into the molten salt bath by using the residual heat at the time of the hot rolling.

Subsequently, the steel wire having a desired diameter is obtained by drawing the immersed wire rod under the particular conditions at room temperature.

Then, the steel wire is formed into the mechanical part by cold working.

After forming, the heat treatment is performed at a relatively low temperature so as to recover the ductility. The heat treatment does not correspond to "quenching and tempering".

With such a method, it is possible to obtain the mechanical part having the tensile strength in a range of 800 MPa to 1600 MPa at low cost, which was extremely difficult to manufacture by the manufacturing method and knowledge in the related art.

Particularly, it is possible to obtain the mechanical part having the tensile strength in a range of 1200 MPa to 1600 MPa at low cost.

Hereinafter, the wire rod for non heat-treated mechanical part according to the present embodiment, the steel wire for non heat-treated mechanical part, and the non heat-treated mechanical part will be described in detail.

First, the reason for limiting the composition of chemical elements of the wire rod, the steel wire, and the non heat-treated mechanical part in the present embodiment will be described in detail.

Hereinafter, the percentage relating to the chemical composition means by mass %.

In the processing of such as the drawing, the cold forging, and forming, the chemical composition is not changed. Thus, the wire rod, the steel wire, and the mechanical part according to the present embodiment have the same chemical composition.

C: 0.18% to 0.65%

C is contained so as to secure the tensile strength of the predetermined steel wire and the mechanical part.

When the amount of C is less than 0.18%, it is difficult to secure the tensile strength of greater than or equal to 800 MPa.

Accordingly, the lower limit of the amount of C is set to 0.18%.

On the other hand, when the amount of C is greater than 0.65%, the cold forgeability of the steel wire is deteriorated.

Accordingly, the upper limit of the amount of C is set to 0.65%.

In the mechanical part having the tensile strength in a range of 800 MPa to 1200 MPa, the amount of C is preferably less than or equal to 0.50%.

On the other hand, in the mechanical part having the tensile strength in a range of 1200 MPa to 1600 MPa, the amount of C is preferably greater than or equal to 0.20%.

In the steel wire, in order to realize both of the high strength and the cold forgeability, the amount of C is more preferably greater than or equal to 0.21%, and in the mechanical part having the tensile strength in a range of 1200 MPa to 1600 MPa, the amount of C is more preferably less than or equal to 0.54%, and in the mechanical part having the tensile strength in a range of 800 MPa to 1200 MPa, the amount of C is more preferably less than or equal to 0.44%.

Si: 0.05% to 1.5%

Si acts as a deoxidizing element, and has an effect of enhancing the tensile strength of the steel wire and the mechanical part by solid solution strengthening.

When the amount of Si is less than 0.05%, the above-described effect is not sufficient.

Accordingly, the lower limit of the amount of Si is set to 0.05%.

On the other hand, when the amount of Si is greater than 1.5%, the above-described effect is saturated, and the cold workability is deteriorated in the steel wire, and the cracking is likely to occur in the mechanical part.

Accordingly, the upper limit of the amount of Si is set to 1.5%.

In the mechanical part having the tensile strength in a range of 800 MPa to 1200 MPa, the amount of Si is preferably less than or equal to 0.50%.

In order to more sufficiently obtain the effect of Si, the amount of Si is more preferably greater than or equal to 0.18%, in the mechanical part having the tensile strength in a range of 800 MPa to 1200 MPa, the amount of Si is more preferably less than or equal to 0.4%, and in the mechanical part having the tensile strength in a range of 1200 MPa to 1600 MPa, the amount of Si is more preferably less than or equal to 0.90%.

Mn: 0.50% to 2.0%

Mn promotes bainitic transformation and has the effect of enhancing the tensile strength of steel wire and the mechanical part.

When the amount of Mn is less than 0.50%, the above-described effect is not sufficient.

Accordingly, the lower limit of the amount of Mn is set to 0.50%.

On the other hand, when the amount of Mn is greater than 2.0%, the above-described effect is saturated, and the manufacturing cost is increased.

Accordingly, the upper limit of the amount of Mn is set to 2.0%.

When considering that the tensile strength is sufficiently applied to the mechanical part, the amount of Mn is preferably greater than or equal to 0.60% or less than or equal to 1.5%.

P: less than or equal to 0.030%

S: less than or equal to 0.030%

P and S are impurities which are unavoidably mixed into the steel.

These elements are segregated in a grain boundary, and thus cause the hydrogen embrittlement resistance of the mechanical part to be deteriorated.

Accordingly, the amount of P and the amount of S are better to be small, and thus the upper limits of the amount of P and the amount of S are set to 0.030%.

In consideration of the cold workability, the amount of P and the amount of S are preferably less than or equal to 0.015%.

Note that, the lower limits of the amount of P and the amount of S include 0%.

However, P and S of at least about 0.0005% are unavoidably mixed into the steel.

N: less than or equal to 0.0050%

N causes the cold workability of the steel wire to be deteriorated due to dynamic strain aging.

Accordingly, the amount of N is better to be small, and thus the upper limit of the amount of N is set to 0.0050%.

In consideration of the cold workability, the amount of N is preferably less than or equal to 0.0040%.

Note that, the lower limit of the amount of N includes 0%.

However, N of at least about 0.0005% is unavoidably mixed into the steel.

O: less than or equal to 0.01%

O is unavoidably mixed into the steel, and remains as an oxide with Al and Ti.

When the amount of O is large, coarse oxides are formed, which causes fatigue fracture at the time of being used as mechanical part.

Accordingly, the upper limit of the amount of O is set to 0.01%.

Note that, the lower limit of the amount of O includes 0%.

However, O of at least about 0.001% is unavoidably mixed into the steel.

The above description is for the basic chemical composition of the wire rod for non heat-treated mechanical part, the steel wire for non heat-treated mechanical part, and the non heat-treated mechanical part according to the present embodiment, and the remainder is Fe and impurities.

Note that, the term "impurities" in the sentence "the remainder of Fe and impurities" means unavoidably mixed elements from ores or scraps as raw materials, or the manufacturing environment at the time of industrially manufacturing the steel.

However, in the wire rod for non heat-treated mechanical part, the steel wire for non heat-treated mechanical part, and the non heat-treated mechanical part of the present embodiment, in addition to the base element, Al, Ti, B, Cr, Mo, Nb, and V may be contained instead of a portion of Fe of the remainder.

In the wire rod for non heat-treated mechanical part, the steel wire for non heat-treated mechanical part, and the non heat-treated mechanical part according to the present embodiment, Al in a range of 0% to 0.050% and Ti in a range of 0% to 0.050% may be contained.

Al and Ti are optionally contained, and thus the amount of Al and the amount of Ti may be 0%.

These elements act as deoxidizing elements, and have a function of reducing a solid soluted N by forming AlN and TiN, and suppress the dynamic strain aging.

AlN and TiN act as pinning particles, and make the grains fine so as to improve the cold workability.

However, when the amount of Al and the amount of Ti are greater than 0.05%, there is a case where coarse oxides such as $Al_2O_3$ and $TiO_2$ are formed, which causes fatigue fracture at the time of being used as mechanical part.

For this reason, the upper limits of the amount of Al and the amount of Ti are preferably set to 0.05%.

Al: 0% to 0.050%

When the amount of Al is less than 0.010%, the above-described effect is not obtained in some cases.

Accordingly, in order to securely obtain the effect, the lower limit of the amount of Al is preferably set to 0.010%.

On the other hand, when the amount of Al is greater than 0.050%, the above-described effect is saturated.

Accordingly, the upper limit of the amount of Al is less than or equal to 0.050%.

In order to more sufficiently obtain the effect of Al, the amount of Al is more preferably of greater than or equal to 0.015%, and is preferably less than or equal to 0.045%.

Ti: 0% to 0.050%

When the amount of Ti is less than 0.005%, the above-described effect is not obtained in some cases.

Accordingly, in order to securely obtain the effect, the lower limit of the amount of Ti is preferably set to 0.005%.

On the other hand, the amount of Ti is greater than 0.050%, the above-described effect is saturated.

Accordingly, the upper limit of the amount of Ti is set to 0.050%.

In order to more sufficiently obtain the effect of Ti, the amount of Ti is more preferably of greater than or equal to 0.010%, and is preferably less than or equal to 0.040%.

In the wire rod for non heat-treated mechanical part, the steel wire for non heat-treated mechanical part, and the non heat-treated mechanical part according to the present embodiment, B may be contained in a range of 0% to 0.0050%.

B is optionally contained, and thus the amount of B may be 0%.

B: 0% to 0.0050%

B promotes bainitic transformation and has an effect of enhancing the tensile strength of steel wire and the mechanical part.

When the amount of B is less than 0.0005%, the above-described effect is not sufficient in some cases.

Accordingly, in order to securely obtain the effect, the lower limit of the amount of B is preferably set to less than or equal to 0.0005%.

On the other hand, when the amount of B is greater than 0.0050%, the above-described effect is saturated.

Accordingly, the upper limit of the amount of B is less than or equal to 0.0050%.

In order to more sufficiently obtain the effect of B, the amount of B is more preferably greater than or equal to 0.0008%, and is preferably less than or equal to 0.0030%.

In the non heat-treated wire rod for mechanical part, the steel wire for non heat-treated mechanical part, and the non heat-treated mechanical part according to the present embodiment, Cr: 0% to 1.50%, Mo: 0% to 0.50%, Nb: 0% to 0.050%, and V: 0% to 0.20% may be contained.

Cr, Mo, Nb, and V are optionally contained, and thus the amount thereof may be 0%.

Cr, Mo, Nb, and V promote bainitic transformation and have an effect of enhancing the tensile strength of steel wire and the mechanical part.

Cr: 0% to 1.50%

When the amount of Cr is less than 0.01%, the above-described effect is not obtained in some cases.

Accordingly, in order to securely obtain the effect, the lower limit of the amount of Cr is preferably set to 0.01%.

On the other hand, when the amount of Cr is greater than 1.50%, the alloy cost is increased.

Accordingly, the upper limit of the amount of Cr is set to 1.50%.

Mo: 0% to 0.50%

When the amount of Mo is less than 0.01%, the above-described effect is not obtained in some cases.

Accordingly, in order to securely obtain the effect, the lower limit of the amount of Mo is preferably set to 0.01%.

On the other hand, when the amount of Mo is greater than 0.50%, the alloy cost is increased.

Accordingly, the upper limit of the amount of Mo is set to 0.50%.

Nb: 0% to 0.050%

When the amount of Nb is less than 0.005%, the above-described effect is not obtained in some cases.

Accordingly, in order to obtain the effect, the lower limit of the amount of Nb is preferably set to 0.005%.

On the other hand, when the amount of Nb is greater than 0.050%, the alloy cost is increased.

Accordingly, the upper limit of the amount of Nb is set to 0.050%.

V: 0% to 0.20%

When the amount of V is less than 0.01%, the above-described effect is not obtained in some cases.

Accordingly, in order to obtain the effect, the lower limit of the amount of V is preferably set to 0.01%.

On the other hand, when the amount of V is greater than 0.20%, the alloy cost is increased.

Accordingly, the upper limit of the amount of V is set to 0.20%.

<F1≥2.0>

In addition, in a case where B is not contained, or in a case where the amount of B is less than 0.0005%, F1 which is obtained by Expression 10 is preferably set to greater than or equal to 2.0.

In Expression 10, [C %] represents the amount of C by mass %, [Si %] represents the amount of Si by mass %, [Mn %] represents the amount of Mn by mass %, [Cr %] represents the amount of Cr by mass %, and [Mo %] represents the amount of Mo by mass %.

$$F1=0.6\times[C\ \%]-0.1\times[Si\ \%]+1.4\times[Mn\ \%]+1.3\times[Cr\ \%]+3.7\times[Mo\ \%] \quad \text{(Expression 10)}$$

When F1 obtained by the above-described Expression 10 is set to greater than or equal to 2.0, it is possible to obtain more stable bainite in the wire rod.

In the wire rod for non heat-treated mechanical part, the steel wire for non heat-treated mechanical part, and the non heat-treated mechanical part according to the present embodiment, it is necessary to hot-rolling a billet having the above chemical composition and to have a specific microstructure.

Then, the reason for limitation of the microstructure will be described in order of the steel wire for non heat-treated mechanical part, the wire rod for non heat-treated mechanical part, and the non heat-treated mechanical part according to the present embodiment.

The steel wire for non heat-treated mechanical part according to the present embodiment has the following features (i) to (p). Note that, the chemical composition of (i) is described above, and thus will not be described in the following paragraph.

(i) The above chemical composition is contained.

(j) When the amount of C is set to [C %] by mass %, the structure includes bainite having greater than or equal to 75×[C %]+25%, by volume %.

(k) The remainder is one or more of ferrite and pearlite.

(l) In the cross section parallel to the longitudinal direction of the steel wire, when the diameter of the steel wire is set to $D_2$ mm, the area from the surface of the steel wire to the depth of $0.1\times D_2$ mm toward the center line of the steel wire is set as the second surface layer area of the steel wire, the average aspect ratio of the bainite block in the second surface layer area of the steel wire is set to R1, the R1 is greater than or equal to 1.2.

(m) In the cross section perpendicular to the longitudinal direction of the steel wire, when the diameter of the steel wire is set to $D_2$ mm, the area from the surface of the steel wire to the depth of $0.1\times D_2$ mm toward the center of the cross section is set as a third surface layer area of the steel wire, and the average grain size of the bainite block in the third surface layer area is set to $P_{S3}$ μm, $P_{S3}$ satisfies Expression 11.

$$P_{S3}\leq 20/R1 \quad \text{(Expression 11)}$$

(n) In the cross section perpendicular to the longitudinal direction of the steel wire, when the diameter of the steel wire is set to $D_2$ mm, the area from a depth of $0.25\times D_2$ mm to the center of the cross section is set as the third center portion of the steel wire, the average grain size of the bainite block $P_{S3}$ μm in the third surface layer area and the average grain size of the bainite block $P_{C3}$ μm in the third center portion satisfy Expression (12).

$$P_{S3}/P_{C3}\leq 0.95 \quad \text{(Expression 12)}$$

(o) The standard deviation of the grain size of the bainite block is less than or equal to 8.0 μm.

(p) The tensile strength is in a range of 800 MPa to 1600 MPa.

<(j) Lower Limit of Volume Percentage of Bainite: 75×[C %]+25>

In the steel wire according to the present embodiment, the bainite structure is controlled.

The bainite is a structure having high strength and excellent workability.

In a case where the volume percentage of the bainite $V_B$, by volume %, does not satisfy Expression 13, the tensile strength of the steel wire is deteriorated, and a non-bainite structure which is the remainder becomes a starting point of the fracture.

As a result, at the time of cold forging for manufacturing the mechanical part, the cracking is likely to occur.

Accordingly, the lower limit of the volume percentage of the bainite of the steel wire $V_B$ is required to satisfy Expression 14.

$$V_B\geq 75\times[C\ \%]+25 \quad \text{(Expression 13)}$$

Here, [C %] means the amount of C of the steel wire.

Note that, in the steel wire, in a case where the tensile strength in a range of 1200 MPa to 1600 MPa is required, the lower limit of the volume percentage of the bainite of the steel wire $V_B$, by volume %, preferably satisfies Expression 14.

$$V_B\geq 45\times[C\ \%]+50 \quad \text{(Expression 14)}$$

In addition, the volume percentage of the bainite $V_B$ is determined by a manufacturing method of the wire rod, which will be described below, and is constant without being changed in the steel wire according to the present embodiment, and the wire rod which is a material of the steel wire, and the mechanical part obtained by cold-forging the steel wire.

<(k) Remainder Structure: Ferrite and Pearlite>

The steel wire according to the present embodiment can contain ferrite and pearlite as a remainder structure other than bainite.

On the other hand, regarding the martensite, cracks are likely to occur at the time of cold forging for forming the mechanical part.

Thus, the steel wire according to the present embodiment does not preferably contain martensite.

<(l) Average Aspect Ratio of Bainite Block R1: Greater Than or Equal to 1.2>

The steel wire according to the present embodiment has a diameter $D_2$ mm.

In the steel wire, the average aspect ratio of the bainite block R1 in the second surface layer area, which is measured based on the L cross section which is the cross section parallel to the longitudinal direction is greater than or equal to 1.2.

In the second surface layer area of the steel wire, when the average aspect ratio of the bainite block R1 measured based on the L cross section is less than 1.2, the cold workability is deteriorated.

Thus, the average aspect ratio of the bainite block R1 is set to greater than or equal to 1.2.

Note that, the average aspect ratio R1 is a ratio of the major axis to the minor axis of the bainite block grain.

Figure 2A:
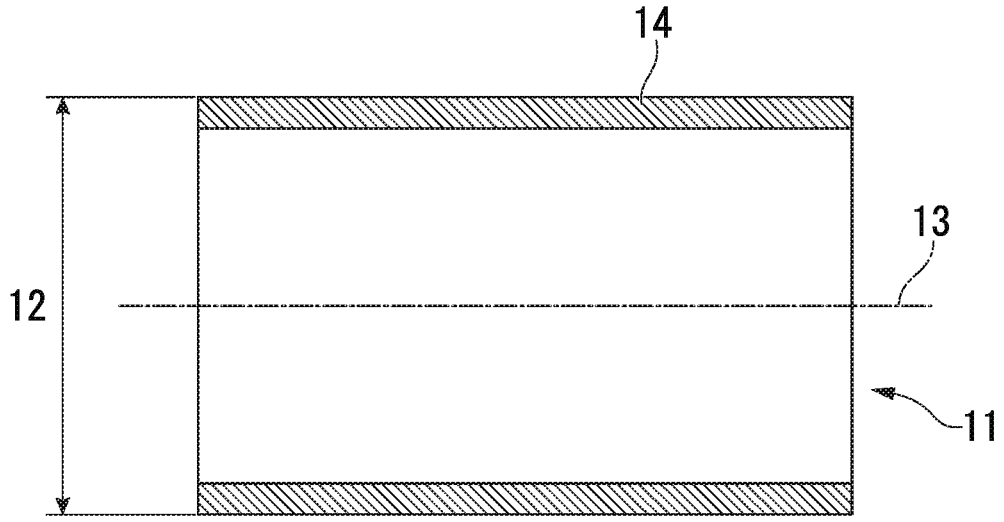
FIG. 2A is a diagram illustrating an area from a surface of the steel wire to a depth of $0.1D_2$ mm from a center line of the cross section, that is, a second surface layer area, when a diameter of the steel wire is set to $D_2$ mm in the cross section parallel to a longitudinal direction of a steel wire for non heat-treated mechanical part according to the first aspect of the present invention.

Here, the second surface layer area is an area from the surface of the steel wire to the depth of $0.1\times D_2$ mm, as illustrated in FIG. 2A.

In a case where the tensile strength in a range of 800 MPa to 1200 MPa is required in the steel wire, in order to realize both of the cold workability and the tensile strength, the average aspect ratio of the bainite block R1 may be less than or equal to 2.0.

In addition, in a case where the tensile strength in a range of 1200 MPa to 1600 MPa is required in the steel wire, in order to realize both of the cold workability and the tensile strength, the average aspect ratio of the bainite block R1 may be greater than or equal to 1.5.

<(m) Average Grain Size of Bainite Block $P_{S3}$ of Third Surface Layer Area: Less Than or Equal to 20/R1>

The steel wire according to the present embodiment has a diameter $D_2$ mm.

In the steel wire, the average grain size of the bainite block $P_{S3}$ in the third surface layer area, which is measured based on the C cross section which is the cross section perpendicular to the longitudinal direction, by unit μm, satisfies Expression 15.

In a case where the average grain size of the bainite block $P_{S3}$ μm of the third surface layer area, which is measured based on the C cross section, does not satisfy Expression 15, that is, it is greater than (20/R1) μm, the cold forgeability of the steel wire is deteriorated.

Figure 2B:
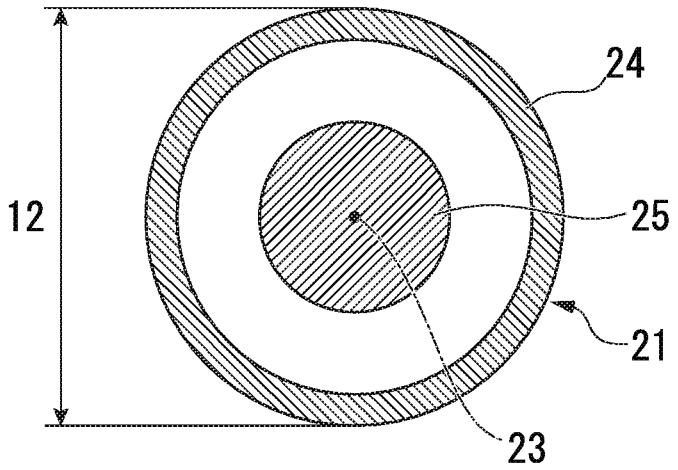
FIG. 2B is a diagram illustrating an area from the surface of the steel wire to a depth of $0.1D_2$ mm toward the center of the cross section, that is, a third surface layer area, and an area from a depth of $0.25D_2$ mm to the center of the cross section, that is, a third center portion, when the diameter of the steel wire is set to $D_2$ mm in the cross section perpendicular to the longitudinal direction of the steel wire for non heat-treated mechanical part according to the first aspect of the present invention.

Here, the third surface layer area is an area from the surface of the steel wire to the depth of $0.1\times D_2$ mm in the C cross section of the steel wire, as illustrated in FIG. 2B.

$$P_{S3}\leq 20/R1 \quad \text{(Expression 15)}$$

<(n) $P_{S3}/P_{C3}\leq 0.95$>

In the steel wire according to the present embodiment, when the diameter of the steel wire is set to $D_2$ mm in the cross section perpendicular to the longitudinal direction of the steel wire, the average grain size of the bainite block $P_{S3}$ μm of the area from the surface of the steel wire to the depth of $0.1\times D_2$ mm, that is, the third surface layer area, and the average grain size of the bainite block $P_{C3}$ μm of the area from the depth of $0.25\times D_2$ mm to the center, that is, the third center portion satisfy Expression 16.

$$P_{S3}/P_{C3}\leq 0.95 \quad \text{(Expression 16)}$$

Here, $P_{S3}$ means the average grain size of the bainite block, by unit μm, in the third surface layer area of the steel wire, $P_{C3}$ means the average grain size of the bainite block, by unit μm, in the third center portion of the steel wire.

When the ratio of the $P_{S3}$ to $P_{C3}$ is greater than 0.95, the cracking is likely to occur at the time of the cold forging.

Accordingly, the ratio $P_{S3}/P_{C3}$ of the average grain size of the bainite block is less than or equal to 0.95.

In the steel wire, the upper limit of the ratio $P_{S3}/P_{C3}$ of the average grain size of the bainite block is preferably 0.90.

<(o) Standard Deviation of Grain Size of Bainite Block: Less Than or Equal to 8.0 μm>

In the steel wire according to the present embodiment, the standard deviation of the grain size of the bainite block is less than or equal to 8.0 μm.

In the steel wire, when the standard deviation of the grain size of the bainite block is greater than 8.0 μm, the variation of the grain sizes of the bainite block becomes larger, and the cracking is likely to occur at the time of performing the cold forging on the mechanical part.

Accordingly, in the steel wire, the upper limit of the standard deviation of the grain size of the bainite block is set to 8.0 μm.

<(p) Tensile Strength: 800 MPa to 1600 MPa>

In the steel wire according to the present embodiment, the tensile strength is in a range of 800 MPa to 1600 MPa.

In the present embodiment, the obtaining of the non heat-treated mechanical part having the tensile strength of greater than or equal to 800 MPa is basically described, and thus the same level of tensile strength is required for the steel wire before being processed into mechanical part.

On the other hand, with the steel wire of greater than 1600 MPa, it is difficult to manufacture the mechanical part by cold-forging the steel wire.

Therefore, as the strength of the steel wire, the tensile strength is set to in a range of 800 MPa to 1600 MPa.

The tensile strength is preferably in a range of 1200 MPa to 1600 MPa, is more preferably in a range of 1240 MPa to 1560 MPa, and is still more preferably greater than or equal to 1280 and less than 1460 MPa.

In order to obtain such a steel wire for non heat-treated mechanical part according to the present embodiment, the wire rod which is a material thereof is required to have the following features (q) to (v). Note that, the chemical composition of (q) is described above, and thus will not be described in the following paragraph.

(q) The above chemical composition is contained.

(r) When the amount of C is set to [C %] by mass %, the structure includes bainite having greater than or equal to 75×[C %]+25%, by volume %.

(s) The remainder is one or more of ferrite and pearlite without martensite.

(t) The average grain size of the bainite block of the structure is in a range of 5.0 μm to 20.0 μm.

(u) The standard deviation of the grain size of the bainite block is less than or equal to 15.0 μm.

(v) In the cross section perpendicular to the longitudinal direction of the wire rod, when the diameter of the wire rod is set to $D_1$ mm, the area from the surface of the wire rod to the depth of $0.1\times D_1$ mm toward the center of the cross section is set as the first surface layer area of the wire rod, and the area from the depth of $0.25\times D_1$ mm to the center of the cross section is set as the first center portion of the wire rod, the average grain size of the bainite block $P_{S1}$ μm in the first surface layer area, and the average grain size of the bainite block $P_{C1}$ μm in the first center portion satisfy Expression 17.

$$P_{S1}/P_{C1}\leq 0.95 \quad (17)$$

<(r) Lower Limit of Volume Percentage of Bainite: 75×[C %]+25>

As described above, in the steel wire according to the present embodiment, the bainite structure is controlled. The volume percentage of the bainite $V_B$ is not changed due to the drawing, and thus in order to obtain the steel wire according to the present embodiment, the volume percentage of the bainite $V_B$ is required to be controlled at the stage of the wire rod.

In a case where the volume percentage of the bainite $V_B$, by volume %, does not satisfy Expression 18, it is not possible to obtain excellent drawability, and a non-bainite structure which is the remainder becomes a starting point of the fracture.

Accordingly, the lower limit of the volume percentage of the bainite $V_B$ of the wire rod is required to satisfy Expression 18.

$$V_B>75\times[C\ \%]+25 \quad \text{(Expression 18)}$$

Here, [C %] means the amount of C of the wire rod.

Note that, in the steel wire, it is necessary to satisfy the above-described Expression 14, and when the amount of C is in a range of 0.20% to 0.65%, the lower limit of the volume percentage of the bainite $V_B$ of the wire rod, by volume %, preferably satisfies Expression 19.

$$V_B>45\times[C\ \%]+50 \quad \text{(Expression 19)}$$

<(s) Remainder Structure: Ferrite and Pearlite>

The wire rod which is a material of the steel wire according to the present embodiment can contain one or more of ferrite and pearlite as a remainder structure other than bainite.

On the other hand, the martensite causes breaking at the time of the drawing, and thus the drawability is deteriorated.

For this reason, the wire rod does not contain the martensite.

<(t) Average Grain Size of Bainite Block: 5.0 μm to 20.0 μm>

As described above, in order to obtain the steel wire according to the present embodiment, the average grain size of the bainite block is required to be controlled at the stage of the wire rod.

When the average grain size of the bainite block is greater than 20.0 μm in the wire rod, the cracks are likely to occur at the time of performing the drawing on the steel wire, and the variation of the grain sizes of the bainite block becomes larger in the steel wire after the drawing.

Accordingly, the upper limit of the average grain size of the bainite block of the wire rod is set to 20.0 μm.

On the other hand, when the average grain size of the bainite block is to be less than 5.0 μm in the wire rod, the manufacturing method becomes complicated and the manufacturing cost rises.

Accordingly, the lower limit of the average grain size of the bainite block of the wire rod is set to 5.0 μm.

<(u) Standard Deviation of Grain Size of Bainite Block: Less Than or Equal to 15.0 μm>

As described above, in order to obtain the steel wire according to the present embodiment, the variation of the grain sizes of the bainite block is required to control at the stage of the wire rod.

For this reason, the standard deviation of the grain size of the bainite block is less than or equal to 15.0 μm in the wire rod.

When the standard deviation of the grain size of the bainite block of the wire rod is greater than 15.0 μm, the variation of the grain sizes of the bainite block becomes larger, and the cold workability of the steel wire after the drawing may be deteriorated in some cases.

Accordingly, in the wire rod, the upper limit of the standard deviation of the grain size of the bainite block is set to 15 μm.

<(v) $P_{S1}/P_{C1} \leq 0.95$>

As described above, in order to obtain the steel wire according to the present embodiment, the grain size of the bainite block of the surface layer area is required to be controlled at the stage of the wire rod.

As illustrated in FIG. 1, in the cross section perpendicular to the longitudinal direction of the wire rod, when the diameter of the wire rod is set to $D_1$ mm, the area from the surface of the wire rod to the depth of $0.1 \times D_1$ mm is set as the first surface layer area, and the area from the depth of $0.25 \times D_1$ mm to the center of the cross section is set as the first center portion.

The average grain size of the bainite block $P_{S1}$ of the first surface layer area, and the average grain size of the bainite block $P_{C1}$ of the first center portion satisfy Expression 20.

$$P_{S1}/P_{C1} \leq 0.95 \quad \text{(Expression 20)}$$

Here, $P_{S1}$ means the average grain size of the bainite block, by unit μm, in the first surface layer area of the wire rod, and $P_{C1}$ means the average grain size of the bainite block, by unit μm, in the first center portion of the wire rod.

In the wire rod, when the ratio of $P_{S1}$ and $P_{C1}$ is greater than 0.95, the cracks are likely to occur at the time of the drawing, and the cold workability of the steel wire is deteriorated.

Accordingly, in the wire rod, the ratio $P_{S1}/P_{C1}$ of the average grain size of the bainite block is set to less than or equal to 0.95.

The upper limit of the ratio $P_{S1}/P_{C1}$ of the average grain size of the bainite block is preferably 0.90.

In order to form the steel wire, which is manufactured as described above, into the mechanical part having a desired tensile strength and the hydrogen embrittlement resistance, when the wire diameter of the steel wire is set to $D_3$ mm, the form of the structure in the area from the surface to the depth of $0.1 \times D_3$ mm is important.

When the cold working is performed on the steel wire according to the present embodiment, it is possible to obtain the non heat-treated mechanical part according to the present embodiment.

The non heat-treated mechanical part according to the present embodiment has a cylindrical axis, and the following features (I) to (VIII). Note that, the chemical composition of (I) is described above, and thus will not be described in the following paragraph.

(I) The above chemical composition is contained.

(II) When the amount of C is set to [C %] by mass %, the structure includes bainite having greater than or equal to 75×[C %]+25%, by volume %.

(III) The remainder is one or more of ferrite and pearlite.

(IV) In the cross section parallel to the longitudinal direction of the axis, when the diameter of the axis is set to $D_3$ mm, an area from the surface of the axis to the depth of $0.1 \times D_3$ mm toward the center of the axis is set as the fourth surface layer area of the mechanical part, and the average aspect ratio of the bainite block in the fourth surface layer area of the mechanical part is set to R2, the R2 is greater than or equal to 1.2.

(V) In the cross section perpendicular to the longitudinal direction of the axis, when the diameter of the axis is set to $D_3$ mm, the area from the surface of the axis to the depth of $0.1 \times D_3$ mm toward the center of the cross section is set as the fifth surface layer area of the mechanical part, and the average grain size of the bainite block in the fifth surface layer area is set to $P_{S5}$ μm, $P_{S5}$ satisfies Expression 21.

$$P_{S5} \leq 20/R2 \quad \text{(Expression 21)}$$

(VI) In the cross section perpendicular to the longitudinal direction of the axis, when the diameter of the axis is set to $D_3$ mm, the area from the depth of $0.25 \times D_3$ mm to the center of the cross section is set to the fifth center portion of the mechanical part, the average grain size of the bainite block $P_{S5}$ μm in the fifth surface layer area, and the average grain size of the bainite block $P_{C5}$ μm in the fifth center portion satisfy Expression 22.

$$P_{S5}/P_{C5} \leq 0.95 \quad \text{(Expression 22)}$$

(VII) The standard deviation of the grain size of the bainite block is less than or equal to 8.0 μm.

(VIII) The tensile strength is in a range of 800 MPa to 1600 MPa.

In the non heat-treated mechanical part according to the present embodiment, the reason for limitation of the above (I) to (VII) is the same as the reason for limitation of the above features (i) to (o) of the steel wire for non heat-treated mechanical part according to the present embodiment.

The reason for this is that in process of manufacturing the mechanical part by cold-forging the steel wire, the chemical composition and the volume percentage of the structure are not changed, and the standard deviation of the grain size of the bainite block, the average aspect ratio, and the ratio of the average grain size of the surface layer area to the average grain size of the center portion are hardly changed.

Further, the diameter $D_2$ mm of the steel wire may be the same as the diameter $D_3$ mm of the cylindrical axis of the mechanical part.

In addition, the non heat-treated mechanical part may be a bolt.

<(VIII) Tensile Strength: 800 MPa to 1600 MPa>

In the non heat-treated mechanical part according to the present embodiment, the tensile strength is in a range of 800 MPa to 1600 MPa.

The present invention is based on obtaining the non heat-treated mechanical part having the tensile strength of greater than or equal to 800 MPa. As the strength of the parts, when the tensile strength is less than 800 MPa, the present invention is not required to be applied.

On the other hand, the parts having the tensile strength of greater than 1600 MPa is deteriorated in the hydrogen embrittlement properties.

Thus, as the strength of the parts, the tensile strength is set to in a range of 800 MPa to 1600 MPa.

The tensile strength is preferably in a range of 1200 MPa to 160001600 MPa, is more preferably in a range of 1240 MPa to 1560 MPa, and still more preferably greater than or equal to 1280 and less than 1460 MPa.

Next, a method of measuring the structure of the steel wire for non heat-treated mechanical part according to the present embodiment, the wire rod for non heat-treated mechanical part, and the non heat-treated mechanical part will be described.

<Measuring Method of Volume Percentage of Bainite>

The volume percentage of the bainite is obtained by photographing the C cross section of the wire rod, that is, the cross section perpendicular to the longitudinal direction of the wire rod at a magnification of 1,000-fold by using a scanning electron microscope, and then performing the image analysis on the photographed cross section.

For example, in the C cross section of the wire rod, the vicinity (the first surface layer area) of the surface layer (surface) of the wire rod, a ¼ $D_1$ portion (the center direction of the wire rod from the surface of the wire rod, that is, a portion which is ¼ of the diameter of the wire rod $D_1$ in the depth direction), and a ½ $D_1$ portion (the first center portion: the center portion of the wire rod) are photographed in an area of 125 μm×95 μm.

It is possible to obtain the area ratio of the bainite by measuring the area of each bainite in the area, and dividing the total value by an observation area.

Note that, the area ratio of the non-bainite structure is obtained by subtracting the area ratio of bainite from 100%.

The area ratio of the structure contained in the observed section, that is, in the C cross section is the same as the volume percentage of the structure, and thus the area ratio obtained by the image analysis is the volume percentage of the structure.

Note that, the volume percentage of the bainite of the steel wire and the mechanical part can also be measured in the same way.

<Definition of Grain Size of Bainite Block>

The bainite block means the following.

For example, in the grain orientation map of the bcc structure which measured by using an electron back scatter diffraction pattern (EBSD) device, a boundary of which the orientation difference is greater than or equal to 15° is set as the bainite block grain boundary.

In addition, the circle equivalent grain size of one bainite block grain obtained by the method described later is defined as a grain size of the bainite block.

<Method of Measuring Average Grain Size of Bainite Block>

The grain size of the bainite block can be measured, for example, by using the electron back scatter diffraction pattern (EBSD) device.

Specifically, regarding the wire rod, in the C cross section which is the cross section perpendicular to the longitudinal direction of the wire rod, when the diameter of the wire rod is set to $D_1$ mm, the average grain size is measured based on the area from the surface to the depth of $0.1\times D_1$ mm, that is, the first surface layer area and the first center portion.

Here, the first center portion is, as illustrated in FIG. 1, an area from the position which is ¼ of the diameter $D_1$ mm from the surface of the wire rod in the center direction.

In other words, an area of the depth in a range of ¼ $D_1$ mm to ½ $D_1$ mm of the wire rod is the first center portion.

In addition, in the first surface layer area and the first center portion, the area of 275 μm×165 μm is measured, and the volume of each bainite block is calculated from the circle equivalent grain size of the bainite block in the visual field so as to define the volume average as the average grain size.

In addition, the average grain size of the bainite block is the average grain size of the first surface layer area and the first center portion.

Note that, it can be also measured in the steel wire and the mechanical part by using the same method as described above.

<Method of Measuring Standard Deviation of Bainite Block>

The standard deviation of the grain size of the bainite block can be determined from the distribution of the respective measurement values by measuring each position at every 45° in the first surface layer area and the first center portion as described above.

Note that, it can be also calculated in the steel wire and the mechanical part by using the same method as described above.

<Method of Measuring Average Aspect Ratio of Bainite Block>

The average aspect ratio of the bainite block can be measured by using the following method.

Specifically, as illustrated in FIG. 2A, in the L cross section which is the cross section parallel to the longitudinal direction of the steel wire, the range from the surface to the depth of $0.1\times D_2$ mm toward the center line of the cross section, that is, an area of 275 μm×165 μm is measured in the second surface layer area by using the EBSD.

Each bainite block in that area is regarded as a circle or an ellipse, the aspect ratio is calculated from the major axis and the minor axis perpendicular to the major axis, and the calculated values are averaged so as to obtain the average aspect ratio of the bainite block R1 in the second surface layer area.

Note that, R2 can be also measured in the mechanical part by using the same method as described above.

<Measuring Method of Ratio of $P_{S1}$ to $P_{C1}$>

The ratio of the average grain size of the bainite block $P_{S1}$ of the first surface layer area of the wire rod to the average grain size of the bainite block $P_{C1}$ of the center portion can be obtained by the following method.

As illustrated in FIG. 1, in the C cross section which is the cross section perpendicular to the longitudinal direction of the wire rod, when the diameter of the wire rod is set to $D_1$ mm, the area from the surface to the depth of $0.1 \times D_1$ mm is set as the first surface layer area.

In addition, as illustrated in FIG. 1, in the center direction of the surface of the wire rod, the area from the ¼ $D_1$ portion which is ¼ of the diameter $D_1$ mm to the ½ $D_1$ portion is set as the first center portion of the wire rod. In the first surface layer area and the first center portion, the area of 275 μm×165 μm is measured by using the EBSD.

Further, the ratio of $P_{S1}$ to $P_{C1}$ can be obtained by calculating the average grain size from the circle equivalent grain size of the bainite block measured in each area by using the above-described method, and then dividing the average grain size of the bainite block $P_{S1}$ of the first surface layer area by the average grain size of the bainite block $P_{C1}$ of the first center portion.

Note that, even in the steel wire, it is possible to obtain the ratio of $P_{S3}$ to $P_{C3}$ by using the same method as described above.

In addition, even in the mechanical part, it is possible to obtain the ratio of $P_{S5}$ to $P_{C5}$ by using the same method as described above.

When the above chemical composition and structure are satisfied, it is possible to obtain the steel wire excellent in the cold workability, the wire rod which is a material of the steel wire and is excellent in the drawability, and the mechanical part which can realize both of the high strength and the hydrogen embrittlement properties.

In order to obtain the wire rod, the steel wire, and the mechanical part which are described above, the wire rod, the steel wire, and the mechanical part may be manufactured by using a manufacturing method described below.

Next, a preferred method of manufacturing the wire rod, the steel wire, and the mechanical part according to the present embodiment will be described below.

The wire rod, the steel wire, and the mechanical part according to the present embodiment can be manufactured as follows.

Note that, the method of manufacturing the wire rod, the steel wire and the mechanical part described below is merely an example for obtaining the wire rod, the steel wire, and the mechanical part according to the present embodiment, and the invention is not limited to the following process and method, and any method can be employed as long as the method of the present invention can be realized.

In the case of manufacturing the wire rod, the steel wire, and the mechanical part according to the present embodiment, the chemical composition of the steel, the respective processes, and the conditions of the respective processes may be set such that the volume percentage of the bainite, the average grain size of the bainite block, the standard deviation of the grain size of the bainite block, the average aspect ratio of the bainite block of the surface layer area, the average grain size of the bainite block of the surface layer area, and the ratio of the average grain size of the bainite block of the surface layer area to the center portion can securely satisfy the following conditions as described above.

Further, it is possible to set the manufacturing conditions in accordance with the tensile strength required for the mechanical part.

<Method of Manufacturing Wire Rod and Steel Wire>

First, a billet having a predetermined chemical composition is heated.

Then, the heated billet is hot-rolled and is wound in a ring shape at a temperature of higher than 900° C.

After that, two-stage cooling including primary cooling and secondary cooling, which will be described below, is performed, and then isothermal holding (isothermal transformation treatment) is performed so as to obtain a wire rod.

As the primary cooling, the billet is cooled down to 600° C. from a winding end temperature at a primary cooling rate in a range of 20° C./sec to 100° C./sec, and as the secondary cooling, the billet is further cooled down to 500° C. from 600° C. at a secondary cooling rate of lower than or equal to 20° C./sec.

After performing the two-stage cooling, the isothermal holding (isothermal transformation treatment) is performed, and then, the drawing is performed so as to manufacture the steel wire for non heat-treated mechanical part according to the present embodiment having the above-described microstructure.

The winding temperature influences the bainite structure after being transformed.

When the winding temperature is lower than or equal to 900° C., the standard deviation of the grain size of the bainite block becomes larger, and the cracking may occur in the cold workability of the steel wire and the mechanical part in some cases.

For this reason, the winding temperature is set to higher than 900° C.

When the primary cooling rate after the winding is slower than 20° C./sec, the standard deviation of the grain size of the bainite block becomes larger, and the cracking may occur in the cold workability of the steel wire and the mechanical part in some cases.

On the other hand, when the secondary cooling rate from 600° C. to 500° C. is faster than 20° C./sec, the volume percentage of the bainite cannot satisfy the above-described Expression 18.

Accordingly, the billet is cooled down to 600° C. from the winding end temperature at the primary cooling rate in a range of 20° C./sec to 100° C./sec, and is cooled down to 500° C. from 600° C. at the secondary cooling rate of slower than or equal to 20° C./sec.

Specifically, the two-stage cooling is performed by the following method. The wire rod is immersed into the molten salt bath by using the residual heat at the time of the hot rolling so as to cause the isothermal bainitic transformation to occur. That is, the two-stage cooling in which after winding, the wire rod is immediately immersed into a molten salt bath 1 at a temperature range of 350° C. to 500° C. and then is cooled down to 600° C., and then further cooled down to 500° C. is performed. After that, the wire rod is immersed into the molten salt bath 2 at a temperature range of 350° C. to 600° C., which is continuous with the molten salt bath 1 so as to hold isothermal temperature.

The immersing time of the wire rod into the molten salt bath 1 is set to in a range of 5 seconds to 150 seconds, and the immersing time of the wire rod into the molten salt bath 2 is set to in a range of 5 seconds to 150 seconds.

The total immersing time of the wire rod into the molten salt bath 1 and the molten salt bath 2 is set to longer than or equal to 40 seconds.

Particularly, in a case where the tensile strength in a range of 1200 MPa to 1600 MPa is required for the mechanical part, the immersing time of the wire rod into the molten salt bath 1 is set to in a range of 25 seconds to 150 seconds, and the immersing time of the wire rod into the molten salt bath 2 is preferably set to in a range of 25 seconds to 150 seconds.

In addition, in the case where the tensile strength in a range of 1200 MPa to 1600 MPa is required for the mechanical part, the total immersing time of the molten salt bath 1 and the molten salt bath 2 is preferably set to longer than or equal to 60 seconds.

The bainite generated by the isothermal transformation treatment has small variation of the grain sizes of the bainite block as compared with the bainite generated by the continuous cooling treatment.

As described above, the immersing time of the wire rod into each of the molten salt baths is set to in a range of 5 seconds to 150 seconds from the viewpoint of sufficient temperature holding and productivity of the wire rod.

Note that, the cooling performed after holding for a predetermined time in the molten salt bath may be water cooling or naturally cooling.

Note that, as the immersing tank, even when facilities such as a lead bath and a fluidized bed are used instead of the molten salt bath, the same effect can be obtained.

However, the molten salt bath is excellent from the viewpoint of environment and manufacturing cost.

With such a method described above, it is possible to manufacture the wire rod which is a material of the steel wire according to the present embodiment.

Note that, in the drawing at the time of manufacturing the steel wire from the wire rod according to the present embodiment, the reduction area is set to in a range of 10% to 80%.

In a case where the reduction area in the drawing is less than 10%, the work hardening is insufficient, and thus the tensile strength is also insufficient.

On the other hand, when the reduction area is greater than 80%, at the time of the cold forging by which the mechanical part is manufactured from the steel wire, the cracking is likely to occur.

Note that, in a case where the tensile strength in a range of 1200 MPa to 1600 MPa is required for the mechanical part, the reduction area in the drawing is preferably set to in a range of 20% to 90%.

In a case where the reduction area in the drawing is less than 20%, the hydrogen embrittlement resistance of the mechanical part is deteriorated.

On the other hand, when the reduction area is greater than 90%, the cracking is more likely to occur at the time of the cold forging by which the mechanical part is manufactured from the steel wire.

Note that, the reduction area in the drawing is preferably in a range of 30% to 86%.

The mechanical part is finally formed by using the steel wire obtained as described above; however, the heat treatment may not be performed before forming the mechanical part so as to maintain the features of the microstructure.

The non heat-treated mechanical part having the tensile strength in a range of 800 MPa to 1600 MPa can be obtained by cold-forging, that is, cold-working the steel wire obtained as described above.

In the mechanical part according to the present embodiment, the tensile strength is set to greater than or equal to 800 MPa.

In a case where the tensile strength which is required for the mechanical part is less than 800 MPa, there is no need to apply the steel wire according to the present embodiment. Particularly, when the tensile strength is greater than or equal to 1200 MPa, the hydrogen embrittlement resistance is remarkably improved.

On the other hand, in a case where the tensile strength which is required for the mechanical part is greater than 1600 MPa, it is difficult to manufacture the mechanical part according to the present embodiment by cold forging, and the hydrogen embrittlement resistance of the mechanical part is deteriorated.

For this reason, the tensile strength of the mechanical part is set to in a range of 800 MPa to 1600 MPa.

As a mechanical part, the mechanical part according to the present embodiment already has high strength as it is.

However, in order to improve the properties of other materials such as yield strength and yield ratio, or ductility, which are required for the mechanical part, the cold forging may be performed so as to form a part shape, and then the mechanical part may be held at a temperature range of 200° C. to 600° C. at for 10 minutes to 5 hours, and then the cooling may be performed.

Note that, the heat treatment does not correspond to the heat treatment for quenching and tempering.

EXAMPLES

Next, examples of the present invention will be described.

However, the conditions in the examples are merely one condition example employed for confirming the feasibility and effect of the present invention, and the present invention is not limited to this one condition example.

The present invention can employ various conditions as long as the object of the present invention is achieved without departing from the gist of the present invention.

The chemical compositions are indicated in Table 1. In addition, the underlines in the table indicate that the component compositions are outside the scope of the present invention.

In the chemical compositions of the steel provided in the examples, the amount of C is set to [C %], the amount of Si is set to [Si %], the amount of Mn is set to [Mn %], the amount of Cr is set to [Cr %], and the amount of Mo is set to [Mo %] so as to calculate F1 from Expression G.

The obtained F1 is indicated in Table 1.

$$F1=0.6\times[C\ \%]-0.1\times[Si\ \%]+1.4\times[Mn\ \%]+1.3\times[Cr\ \%]+3.7\times[Mo\ \%] \quad (G)$$

The billet consisting of the above steel type was hot-rolled such that a wire diameter was 13.0 mm or 16.0 mm.

After the hot rolling, the winding was performed at a winding temperature indicated in Table 2-1, and a two-stage cooling and isothermal holding (isothermal transformation treatment) were performed by using the method indicated in Table 2-1 so as to obtain a wire rod.

Table 2-1 indicates the winding temperature after the hot rolling, a temperature of the molten salt bath 1, a holding time, a primary cooling rate at a temperature down to 600° C. from the winding temperature, a secondary cooling rate at a temperature down to 500° C. from 600° C., and an isothermal holding temperature and an isothermal holding time in the molten salt bath 2.

The wire rod in which the isothermal transformation treatment was performed after performing the two-stage cooling was subjected to the drawing at a reduction area indicated in Table 2-1 so as to obtain a steel wire.

The structure of the wire rod is indicated in Table 2-2-1, and the structure of the steel wire is indicated in Table 2-2-2. Note that, the volume percentage of the bainite in the wire rod, and the volume percentage of the bainite in the steel wire are the same as each other.

Regarding the volume percentage of the bainite $V_B$ (unit: by volume %), the underlines do not satisfy Expression H.

$$V_B \geq 75\times[C\ \%]+25\% \quad (H)$$

In addition, in the remainder of the structure, F represents ferrite, P represents pearlite, and M represents martensite.

The volume percentage of the bainite was obtained by photographing the C cross section of the wire rod, that is, the cross section perpendicular to the longitudinal direction of the wire rod at a magnification of 1,000-fold by using a scanning electron microscope, and then performing the image analysis the photographed cross section.

In the cross section of the wire rod, the vicinity (the first surface layer area) of the surface layer (surface) of the wire rod, a ¼ $D_1$ portion (the center direction of the wire rod from the surface of the wire rod, that is, a portion which is ¼ of the diameter of the wire rod $D_1$ in the depth direction), and a ½ $D_1$ portion (the first center portion: the center portion of the wire rod) were photographed in an area of 125 μm×95 μm.

The area ratio of the bainite was obtained by measuring the area of each bainite in the area, and dividing the total value by an observation area.

Note that, the area ratio of the non-bainite structure was obtained by subtracting the area ratio of bainite from 100%.

The area ratio of the structure contained in the observed section, that is, in the C cross section is the same as the volume percentage of the structure, and thus the area ratio obtained by the image analysis is the volume percentage of the structure.

The volume percentage of the steel wire was also obtained by using the above-described method.

The average grain size of the bainite block of the wire rod in Table 2-2-1 was measured by using the following method.

In the grain orientation map of the bcc structure measured by using the EBSD device, a boundary of which the orientation difference is greater than or equal to 15° was set as the bainite block grain boundary.

Regarding the wire rod, in the C cross section which is the cross section perpendicular to the longitudinal direction of the wire rod, when the diameter of the wire rod was set to $D_1$ mm, the average grain size was measured based on the area from the surface to the depth of $0.1\times D_1$ mm, that is, the first surface layer area and the first center portion.

Here, the first center portion is, as illustrated in FIG. 1, an area from the position which is ¼ of the diameter $D_1$ mm from the surface of the wire rod in the center direction.

In the first surface layer area and the first center portion, the area of 275 μm×165 μm was measured, and the volume of each bainite block was calculated from the circle equivalent grain size of the bainite block in the visual field so as to define the volume average as the average grain size.

In addition, the average grain size of the bainite block was the average grain size of the first surface layer area and the first center portion.

In Table 2-2-1, those in which the average grain size of the bainite block outside the range of 5.0 μm to 20.0 μm were underlined.

The standard deviation of the grain size of the bainite block of the wire rod in Table 2-2-1, and the standard deviation of the grain size of the bainite block of the steel wire in Table 2-2-2 were measured by using the following method.

The standard deviation of the grain size of the bainite block in the wire rod was obtained from the distribution of the measurement value of the first surface layer area and the measurement value of the first center portion. In a case of the steel wire, the standard deviation of the grain size of the bainite block was obtained from the distribution of the measurement value of the third surface layer area and the measurement value of the third center portion.

In Table 2-2-1, those in which the standard deviation of the bainite block was greater than 15.0 μm were underlined, and in Table 2-2-2, those in which the standard deviation of the bainite block was greater than 8.0 μm were underlined.

The average grain size of the bainite block $P_{S1}$ in the first surface layer area of the wire rod and the average grain size of the bainite block $P_{C1}$ in the first center portion are indicated in Table 2-2-1.

The average grain size of the bainite block $P_{S3}$ in the third surface layer area of the steel wire and the average grain size of the bainite block $P_{C3}$ in the third center portion are indicated in Table 2-2-2.

The average grain size of the bainite block $P_{S1}$, $P_{C1}$, $P_{S3}$ and $P_{C3}$ (unit: μm) in the first surface layer area and the first center portion of the wire rod, and in the third surface layer area and the third center portion of the steel wire were measured by using the following method. The area of 275 μm×165 μm was measured by using the EBSD, and the volume of each bainite block was calculated from the circle equivalent grain size of the bainite block in the visual field so as to define the volume average as the average grain size.

Note that, the first surface layer area and the first center portion of the wire rod, and the third surface layer area and the third center portion of the steel wire are as described above.

In addition, in Table 2-2-1, those in which the ratio of the average grain size of the bainite block $P_{S1}$ of the first surface layer area to the average grain size of the bainite block $P_{C1}$ of the first center portion did not satisfy Expression I were underlined.

$$P_{S1}/P_{C1}\leq 0.95 \quad \text{(I)}$$

In Table 2-2-2, those in which the ratio of the average grain size of the bainite block $P_{S3}$ of the third surface layer area to the average grain size of the bainite block $P_{C3}$ of the third center portion did not satisfy Expression J were underlined.

$$P_{S3}/P_{C3}\leq 0.95 \quad \text{(J)}$$

In Table 2-2-2, the average aspect ratio of the bainite block R1 in the second surface layer area of the steel wire was measured by using the following method.

In the L cross section which is the cross section parallel to the longitudinal direction of the steel wire, the area from the surface to the depth of $0.1\times D_2$ mm toward the center line of the cross section, that is, an area of 275 μm×165 μm was measured in the second surface layer area by using the EBSD.

Each bainite block in that area was regarded as a circle or an ellipse, the aspect ratio was calculated from the major axis and the minor axis perpendicular to the major axis, and the calculated values were averaged so as to obtain the average aspect ratio of the bainite block R1 in the second surface layer area.

In Table 2-2-2, those in which the average aspect ratio R1 of the second surface layer area is less than 1.2 were underlined.

Further, in the steel wire, in a case where the relationship between the average aspect ratio R1 of the second surface layer area and the average grain size of the bainite block $P_{S3}$ of the third surface layer area do not satisfy Expression K, the underlines were given.

$$P_{S3}\leq 20/R1 \quad \text{(K)}$$

Table 2-3 indicates the drawability of the wire rod.

Regarding the drawability of the wire rod, in a case where breaking occurred even once at the time of wire drawing from the steel wire from the wire rod, the drawability was determined to be "poor".

In addition, Table 2-3 indicates the tensile strength of the steel wire and the cold workability.

The tensile strength was evaluated by a tensile test based on a testing method of JIS Z 2241 by suing using a test piece 9A of JIS Z 2201.

The cold workability was evaluated by the deformation resistance and the marginal compression ratio.

First, a sample having a size of φ5.0 mm×7.5 mm was made by machining the steel wire after the drawing.

Then, by using the sample, an end face was constrained and compressed in a die with grooves having a concentrical shape.

At this time, the maximum stress (deformation resistance) when the process was performed at a compression ratio of 57.3% corresponding to the strain of 1.0 was obtained so as to evaluate the maximum compression ratio (marginal compression ratio) at which the cracks did not occur.

When the tensile strength of the steel wire was in a range of 800 MPa to 1200 MPa, and the maximum stress when the process was performed at a compression ratio of 57.3% was less than or equal to 1100 MPa, the deformation resistance was determined as "good". In addition, when the maximum compression ratio at which the cracks did not occur was greater than or equal to 70%, the marginal compression ratio was determined as "good".

When the tensile strength of the steel wire was in a range of 1200 MPa to 1600 MPa, and the maximum stress when the process was performed at a compression ratio of 57.3% was less than or equal to 1200 MPa, the deformation resistance was determined as "good". In addition, when the maximum compression ratio at which the cracks did not occur was greater than or equal to 60%, the marginal compression ratio was determined as "good".

Note that, a wire rod in a case where the steel wire having a target structure cannot be formed by drawing the wire rod is described as a comparative example.

Subsequently, the mechanical part was obtained by cold-forging, that is, cold-working the steel wire, and by further performing the heat treatment.

The heat treatment temperature and the holding time after the heat treatment which was performed after the cold-forging of the steel wire are indicated in Table 3-1.

Note that, in Table 3-1, the mechanical part Nos. 1001 to 1018, and 1042 are examples in the case where the tensile strength in a range of 800 MPa to 1200 MPa is required for the mechanical part, and the mechanical part Nos. 1019 to 1036 are examples in the case where the tensile strength in a range of 1200 MPa to 1600 MPa is required for the mechanical part.

In Table 3-1, the volume percentage of the bainite of the mechanical part, the remainder of the structure, the standard deviation of the grain size of the bainite block, the average aspect ratio R2 of the bainite block of the fourth surface layer area, the average grain size $P_{S5}$ of the bainite block of the fifth surface layer area, the average grain size $P_{C5}$ of the bainite block in the fifth surface layer area, and 20/R2 and $P_{S5}/P_{C5}$ are indicated.

These were measured by using the same method as that used in the steel wire.

In Table 3-1, the volume percentage of the bainite which does not satisfy Expression L was underlined.

$$V_B \geq 75\times[C\ \%]+25\% \quad (L)$$

In Table 3-1, those in which the standard deviation of the bainite block is greater than 8.0 μm were underlined.

In Table 3-1, those in which the average aspect ratio R2 of the fourth surface layer area is less than 1.2 were underlined.

In Table 3-1, in a case where the relationship between the average aspect ratio R2 of the fourth surface layer area and the average grain size of the bainite block $P_{S5}$ of the fifth surface layer area does not satisfy Expression M, underlines were given.

$$P_{S5} \leq 20/R2 \quad (M)$$

Further, in Table 3-1, those in which the ratio of the average grain size of the bainite block $P_{S5}$ of the fifth surface layer area to the average grain size of the bainite block $P_{S5}$ of the fifth center portion does not satisfy Expression N were underlined.

$$P_{S5}/P_{C5} \leq 0.95 \quad (N)$$

Table 3-2 indicates the tensile strength and the hydrogen embrittlement resistance of the mechanical part.

Similar to the steel wire, the tensile strength was evaluated by a tensile test based on a testing method of JIS Z 2241 by suing using a test piece 9A of JIS Z 2201.

The hydrogen embrittlement resistance was evaluated by using the following method.

First, the steel wire was processed into a bolt, and in the bolt having the tensile strength in a range of 800 MPa to 1200 MPa, 2.0 ppm of diffusible hydrogen was contained to the sample by using electrolytic hydrogen charges, and in the bolt having the tensile strength in a range of 1200 MPa to 1600 MPa, 0.5 ppm of diffusible hydrogen was contained in the sample.

Thereafter, Cd plating was performed so that hydrogen was not released from the sample into the atmosphere during the test.

Subsequently, a load of 90% of the maximum tensile load was applied in the atmosphere, and the occurrence of the breaking after 100 hours was confirmed.

Then, those in which no breaking occurred were evaluated as "good", and those in which breaking occurred were evaluated as "poor".

TABLE 1

| Steel type | C | Si | Mn | P | S | N | O | Cr | Mo | Ti | Al | B | Nb | V | F1 |
|---|---|---|---|---|---|---|---|---|---|---|---|---|---|---|---|
| A | 0.19 | 0.20 | 0.89 | 0.012 | 0.015 | 0.0042 | 0.0009 | 0.15 | | 0.014 | 0.028 | 0.0018 | | | 1.54 |
| B | 0.19 | 0.16 | 0.92 | 0.009 | 0.012 | 0.0039 | 0.0010 | 0.18 | | 0.022 | 0.031 | 0.0020 | | | 1.62 |
| C | 0.20 | 0.07 | 1.15 | 0.011 | 0.009 | 0.0041 | 0.0013 | 0.14 | | 0.031 | | 0.0017 | | | 1.91 |
| D | 0.21 | 0.12 | 0.90 | 0.012 | 0.011 | 0.0044 | 0.0011 | 0.13 | 0.02 | | 0.049 | 0.0018 | 0.021 | 0.03 | 1.62 |
| E | 0.22 | 0.18 | 1.22 | 0.008 | 0.008 | 0.0037 | 0.0008 | | | | 0.048 | 0.0019 | | | 1.82 |
| F | 0.25 | 0.19 | 1.05 | 0.009 | 0.014 | 0.0035 | 0.0010 | 0.14 | | 0.023 | 0.019 | 0.0022 | | | 1.78 |
| G | 0.32 | 0.09 | 1.40 | 0.008 | 0.018 | 0.0042 | 0.0009 | 0.20 | | | 0.033 | | | | 2.40 |
| H | 0.35 | 0.18 | 0.72 | 0.010 | 0.012 | 0.0045 | 0.0012 | 1.03 | 0.16 | | 0.031 | | | | 3.13 |
| I | 0.33 | 0.17 | 1.02 | 0.014 | 0.014 | 0.0046 | 0.0011 | 0.14 | | 0.018 | 0.034 | 0.0018 | | 0.02 | 1.79 |
| J | 0.45 | 0.08 | 1.21 | 0.012 | 0.012 | 0.0041 | 0.0011 | 0.13 | | 0.024 | 0.024 | 0.0021 | | | 2.13 |
| K | 0.21 | 0.18 | 0.91 | 0.009 | 0.011 | 0.0053 | 0.0012 | 0.15 | | | 0.032 | | | | 1.58 |
| L | 0.22 | 0.19 | 0.73 | 0.012 | 0.012 | 0.0041 | 0.0011 | 1.03 | 0.17 | | 0.032 | | | | 3.10 |
| M | 0.22 | 0.18 | 0.92 | 0.009 | 0.011 | 0.0038 | 0.0009 | 0.16 | | 0.019 | 0.034 | 0.0018 | | 0.02 | 1.61 |
| N | 0.26 | 0.19 | 1.06 | 0.014 | 0.014 | 0.0036 | 0.0013 | 0.15 | | | 0.049 | 0.0021 | | | 1.82 |
| O | 0.33 | 0.18 | 1.03 | 0.011 | 0.009 | 0.0037 | 0.0011 | 0.16 | | 0.022 | 0.028 | 0.0020 | | | 1.83 |

TABLE 1-continued

| Steel type | C | Si | Mn | P | S | N | O | Cr | Mo | Ti | Al | B | Nb | V | F1 |
|---|---|---|---|---|---|---|---|---|---|---|---|---|---|---|---|
| P | 0.36 | 0.18 | 0.73 | 0.014 | 0.010 | 0.0040 | 0.0010 | 1.04 | 0.16 | | 0.031 | | | | 3.16 |
| Q | 0.43 | 0.20 | 0.74 | 0.008 | 0.011 | 0.0036 | 0.0009 | 0.17 | | 0.024 | 0.033 | 0.0022 | | | 1.50 |
| R | 0.46 | 0.21 | 1.22 | 0.009 | 0.012 | 0.0034 | 0.0012 | 0.16 | | 0.022 | 0.030 | 0.0021 | | | 2.17 |
| S | 0.49 | 0.22 | 1.23 | 0.011 | 0.008 | 0.0033 | 0.0009 | 0.18 | | 0.021 | 0.037 | 0.0019 | 0.017 | | 2.23 |
| T | 0.51 | 0.22 | 0.72 | 0.013 | 0.015 | 0.0039 | 0.0012 | 1.03 | 0.16 | | 0.027 | | | | 3.22 |
| U | 0.59 | 0.10 | 1.23 | 0.012 | 0.012 | 0.0038 | 0.0008 | 0.21 | | 0.017 | 0.035 | 0.0018 | 0.018 | | 2.34 |
| V | 0.63 | 0.18 | 1.42 | 0.009 | 0.014 | 0.0040 | 0.0010 | 0.11 | | 0.019 | 0.031 | 0.0019 | | 0.03 | 2.49 |
| W | 0.63 | 0.19 | 0.75 | 0.008 | 0.009 | 0.0035 | 0.0009 | 0.99 | 0.15 | | 0.029 | | | | 3.25 |
| X | 0.42 | 0.25 | 1.06 | 0.012 | 0.015 | 0.0041 | 0.0011 | 0.13 | | | 0.033 | | | | 1.88 |
| Y | 0.11 | 0.23 | 1.31 | 0.012 | 0.010 | 0.0042 | 0.0015 | 0.32 | 0.15 | 0.012 | 0.033 | | 0.023 | 0.05 | 2.85 |
| Z | 0.82 | 0.22 | 0.77 | 0.013 | 0.012 | 0.0044 | 0.0010 | 0.45 | 0.22 | 0.013 | 0.032 | 0.0013 | | | 2.95 |
| AA | 0.24 | 1.82 | 0.65 | 0.015 | 0.013 | 0.0043 | 0.0009 | 0.52 | | | 0.035 | | | | 1.55 |
| AB | 0.55 | 0.23 | 0.25 | 0.009 | 0.008 | 0.0036 | 0.0009 | 1.05 | 0.20 | | 0.032 | | | | 2.76 |
| AC | 0.22 | 0.19 | 2.31 | 0.012 | 0.011 | 0.0041 | 0.0012 | | | 0.012 | 0.034 | | | | 3.35 |

TABLE 2-1

| | | Manufacturing conditions | | | | | | | | |
|---|---|---|---|---|---|---|---|---|---|---|
| | | | Two-stage cooling | | | | | | | |
| | | | Primary cooling rate at temperature down to | Secondary cooling rate at temperature down to | Molten salt bath 1 | | Isothermal holding (isothermal transformation treatment) Molten salt bath 2 | | Total holding time in | Reduction |
| Steel wire No. | Steel type | Winding temperature [° C.] | 600° C. from winding [° C./s] | 500° C. from 600° C. [° C./s] | Temperature [° C.] | Holding time [s] | Temperature [° C.] | Holding time [s] | molten salt bath [s] | area in drawing [%] |
| 101 | A | 910 | 66 | 17 | 460 | 33 | 550 | 49 | 82 | 28.4 |
| 102 | A | 800 | 38 | 24 | 510 | 31 | 550 | 48 | 79 | 28.4 |
| 103 | B | 910 | 69 | 15 | 460 | 28 | 560 | 43 | 71 | 62.1 |
| 104 | C | 910 | 71 | 18 | 450 | 34 | 550 | 50 | 84 | 62.1 |
| 105 | C | 910 | 69 | 18 | 450 | 12 | 450 | 15 | 27 | — |
| 106 | D | 910 | 68 | 16 | 460 | 38 | 540 | 58 | 96 | 52.1 |
| 107 | E | 910 | 71 | 17 | 460 | 27 | 540 | 41 | 68 | 52.1 |
| 108 | F | 910 | 55 | 18 | 460 | 28 | 560 | 43 | 71 | 52.1 |
| 109 | G | 910 | 68 | 15 | 450 | 36 | 550 | 46 | 82 | 62.1 |
| 110 | G | 820 | 5.2 | Blast cooling | | | | | — | 62.1 |
| 111 | G | Batch LP Cooling | | | | | | | — | 62.1 |
| 112 | H | 910 | 64 | 16 | 390 | 42 | 390 | 62 | 104 | 62.1 |
| 113 | H | 910 | 68 | 15 | 450 | 15 | 550 | 20 | 35 | — |
| 114 | H | 820 | 1.0 | Slow cooling | | | | | — | 62.1 |
| 115 | H | Batch LP Cooling | | | | | | | — | 62.1 |
| 116 | I | 910 | 59 | 16 | 390 | 25 | 420 | 38 | 63 | 62.1 |
| 117 | J | 910 | 72 | 17 | 390 | 33 | 420 | 50 | 83 | 52.1 |
| 118 | K | 910 | 69 | 19 | 450 | 29 | 550 | 45 | 74 | 62.1 |
| 119 | L | 920 | 51 | 15 | 380 | 41 | 380 | 62 | 103 | 75.0 |
| 120 | L | 920 | 52 | 15 | 400 | 25 | 550 | 33 | 58 | — |
| 121 | M | 920 | 49 | 14 | 380 | 34 | 420 | 52 | 86 | 75.0 |
| 122 | N | 920 | 47 | 12 | 450 | 33 | 550 | 50 | 83 | 85.9 |
| 123 | O | 920 | 48 | 15 | 380 | 31 | 540 | 47 | 78 | 85.9 |
| 124 | O | 820 | 5.5 | Blast cooling | | | | | — | 85.9 |
| 125 | O | Batch LP Cooling | | | | | | | — | 85.9 |
| 126 | P | 920 | 50 | 13 | 380 | 39 | 390 | 59 | 98 | 75.0 |
| 127 | P | 820 | 1.6 | Naturally cooling | | | | | — | 75.0 |
| 128 | P | Batch LP Cooling | | | | | | | — | 15.6 |
| 129 | Q | 920 | 51 | 11 | 400 | 32 | 480 | 47 | 79 | 85.9 |
| 130 | R | 920 | 53 | 12 | 380 | 34 | 490 | 50 | 84 | 75.0 |
| 131 | S | 920 | 51 | 14 | 380 | 35 | 480 | 52 | 87 | 75.0 |
| 132 | T | 920 | 52 | 15 | 380 | 42 | 390 | 63 | 105 | 75.0 |
| 133 | U | 920 | 51 | 12 | 400 | 38 | 520 | 58 | 96 | 85.9 |
| 134 | V | 920 | 48 | 9 | 400 | 32 | 530 | 47 | 79 | 85.9 |
| 135 | W | 920 | 53 | 12 | 380 | 45 | 390 | 68 | 113 | 75.0 |
| 136 | X | 920 | 49 | 13 | 400 | 33 | 560 | 50 | 83 | 85.9 |
| 137 | Y | 920 | 51 | 14 | 420 | 42 | 480 | 58 | 100 | — |
| 138 | Z | 920 | 51 | 14 | 420 | 42 | 480 | 58 | 100 | — |
| 139 | AA | 920 | 51 | 14 | 420 | 42 | 480 | 58 | 100 | — |
| 140 | AB | 920 | 51 | 14 | 420 | 42 | 480 | 58 | 100 | — |
| 141 | AC | 920 | 51 | 14 | 420 | 42 | 480 | 58 | 100 | — |
| 142 | J | 910 | 74 | 18 | 390 | 33 | 420 | 50 | 83 | 10.2 |

TABLE 2-2-1

| | | | Structure of wire rod | | | | | | | |
|---|---|---|---|---|---|---|---|---|---|---|
| | | | | | | Bainite block | | | | |
| Steel wire No. | Steel type | Wire diameter $D_1$ of wire rod [mm] | Bainite [Volume %] | Bainite Expression (1)*1 lower limit [Volume %] | Remainder*2 | Average grain size [μm] | Standard deviation of grain size [μm] | Average grain size $P_{S1}$ of first surface layer area [μm] | Average grain size $P_{C1}$ of first center portion [μm] | $P_{S1}/P_{C1}$ [—] |
| 101 | A | 13.0 | 45 | 39.3 | F, P | 14.5 | 10.1 | 12.8 | 15.3 | 0.84 |
| 102 | A | 13.0 | 24 | 39.3 | F, P | 15.0 | 12.3 | 13.7 | 15.9 | 0.86 |
| 103 | B | 13.0 | 52 | 39.3 | F, P | 15.1 | 9.7 | 11.8 | 16.4 | 0.72 |
| 104 | C | 13.0 | 55 | 40.0 | F, P | 14.0 | 9.8 | 12.7 | 15.1 | 0.84 |
| 105 | C | 13.0 | 38 | 40.0 | F, P, M | 15.8 | 15.4 | 13.4 | 17.2 | 0.78 |
| 106 | D | 13.0 | 54 | 40.8 | F, P | 13.1 | 8.2 | 10.7 | 14.2 | 0.75 |
| 107 | E | 13.0 | 57 | 41.5 | F, P | 14.5 | 9.4 | 12.9 | 15.4 | 0.84 |
| 108 | F | 13.0 | 52 | 43.8 | F, P | 13.3 | 9.6 | 11.3 | 13.9 | 0.81 |
| 109 | G | 13.0 | 62 | 49.0 | F, P | 14.6 | 10.3 | 12.4 | 15.7 | 0.79 |
| 110 | G | 13.0 | 53 | 49.0 | P, F | 13.4 | 16.7 | 11.9 | 14.0 | 0.85 |
| 111 | G | 13.0 | 82 | 49.0 | P | 21.3 | 9.9 | 22.5 | 20.2 | 1.11 |
| 112 | H | 13.0 | 81 | 51.3 | P | 16.9 | 9.1 | 13.5 | 18.6 | 0.73 |
| 113 | H | 13.0 | 22 | 51.3 | M | 17.8 | 15.5 | 15.6 | 19.9 | 0.78 |
| 114 | H | 13.0 | 58 | 51.3 | P, F | 18.6 | 15.3 | 16.9 | 20.1 | 0.84 |
| 115 | H | 13.0 | 100 | 51.3 | — | 22.9 | 13.3 | 23.8 | 22.1 | 1.08 |
| 116 | I | 13.0 | 78 | 49.8 | F, P | 15.6 | 8.4 | 12.9 | 17.2 | 0.75 |
| 117 | J | 13.0 | 77 | 58.8 | F, P | 16.2 | 7.9 | 13.2 | 17.9 | 0.74 |
| 118 | K | 13.0 | 38 | 40.8 | F, P | 15.7 | 15.5 | 16.1 | 18.3 | 0.88 |
| 119 | L | 16.0 | 96 | 41.5 | F | 13.5 | 10.3 | 11.7 | 14.2 | 0.82 |
| 120 | L | 16.0 | 21 | 41.5 | M, P | 12.6 | 11.1 | 11.3 | 13.3 | 0.85 |
| 121 | M | 16.0 | 79 | 41.5 | P, F | 14.2 | 8.4 | 12.1 | 14.9 | 0.81 |
| 122 | N | 16.0 | 78 | 44.5 | P, F | 12.6 | 8.1 | 11.5 | 13.2 | 0.87 |
| 123 | O | 16.0 | 82 | 49.8 | P, F | 12.9 | 7.8 | 11.3 | 13.8 | 0.82 |
| 124 | O | 16.0 | 71 | 49.8 | P, F | 18.2 | 16.2 | 16.9 | 19.1 | 0.88 |
| 125 | O | 16.0 | 91 | 49.8 | F | 24.6 | 12.9 | 25.6 | 23.9 | 1.07 |
| 126 | P | 16.0 | 97 | 52.0 | F | 11.8 | 8.0 | 10.5 | 12.6 | 0.83 |
| 127 | P | 16.0 | 70 | 52.0 | F, P | 20.3 | 15.9 | 18.5 | 20.9 | 0.89 |
| 128 | P | 16.0 | 100 | 52.0 | — | 18.7 | 9.4 | 19.1 | 18.8 | 1.02 |
| 129 | Q | 16.0 | 88 | 57.3 | P, F | 13.2 | 9.1 | 12.4 | 13.3 | 0.93 |
| 130 | R | 16.0 | 86 | 59.5 | P, F | 12.7 | 9.9 | 12.1 | 13.4 | 0.90 |
| 131 | S | 16.0 | 87 | 61.8 | P | 13.8 | 10.2 | 12.8 | 14.4 | 0.89 |
| 132 | T | 16.0 | 100 | 63.3 | — | 12.1 | 7.9 | 10.6 | 12.8 | 0.83 |
| 133 | U | 16.0 | 89 | 69.3 | P, F | 13.1 | 9.2 | 12.5 | 13.6 | 0.92 |
| 134 | V | 16.0 | 90 | 72.3 | P, F | 12.8 | 9.5 | 11.9 | 13.1 | 0.91 |
| 135 | W | 16.0 | 100 | 72.3 | — | 12.1 | 9.4 | 10.9 | 12.5 | 0.87 |
| 136 | X | 16.0 | 54 | 56.5 | P, F | 14.1 | 12.2 | 13.1 | 14.9 | 0.88 |
| 137 | Y | 16.0 | 32 | 33.3 | F, P, M | 13.9 | 10.6 | 12.7 | 14.5 | 0.88 |
| 138 | Z | 16.0 | 78 | 86.5 | P, M | 14.2 | 10.5 | 13.0 | 14.8 | 0.88 |
| 139 | AA | 16.0 | 65 | 43.0 | F, M | 13.7 | 10.7 | 12.6 | 14.5 | 0.87 |
| 140 | AB | 16.0 | 70 | 66.3 | P, F, M | 13.8 | 10.4 | 12.5 | 14.1 | 0.89 |
| 141 | AC | 16.0 | 91 | 41.5 | M | 14.5 | 11.8 | 13.6 | 15.2 | 0.89 |
| 142 | J | 9.5 | 78 | 58.8 | F, P | 16.0 | 8.1 | 13.1 | 17.7 | 0.74 |

*1(Expression 1) 75 × [C %] + 25

*2P (pearlite), F (ferrite), and M (martensite)

TABLE 2-2-2

| | | | Structure of steel wire | | | | | | | |
|---|---|---|---|---|---|---|---|---|---|---|
| | | | | | Bainite block | | | | | |
| Steel wire No. | Wire diameter $D_2$ of steel wire [mm] | Bainite [Volume %] | Bainite Expression (1)*1 lower limit [Volume %] | Remainder*2 | Standard deviation of grain size [μm] | Average aspect ratio R1 of second surface layer area [—] | Third surface layer area 20/R1 [μm] | Average grain size $P_{S3}$ of third surface layer area [μm] | Average grain size $P_{C3}$ of third center portion [μm] | $P_{S3}/P_{C3}$ [—] |
| 101 | 11.0 | 45 | 39.3 | F, P | 7.7 | 1.3 | 15.4 | 11.7 | 13.6 | 0.86 |
| 102 | 11.0 | 24 | 39.3 | F, P | 10.2 | 1.2 | 16.7 | 13.0 | 15.3 | 0.85 |
| 103 | 8.0 | 52 | 39.3 | F, P | 5.6 | 1.7 | 11.8 | 9.8 | 13.6 | 0.72 |
| 104 | 8.0 | 55 | 40.0 | F, P | 6.3 | 1.6 | 12.5 | 10.2 | 12.2 | 0.84 |
| 105 | — | It was not possible to manufacture steel wire due to breaking at the time of drawing. | | | | | | | | |
| 106 | 9.0 | 54 | 40.8 | F, P | 5.4 | 1.5 | 13.3 | 10.2 | 13.9 | 0.73 |

TABLE 2-2-2-continued

| Steel wire No. | Wire diameter $D_2$ of steel wire [mm] | Structure of steel wire: Bainite [Volume %] | Bainite: Expression (1)*1 lower limit [Volume %] | Bainite: Remainder*2 | Bainite block: Standard deviation of grain size [μm] | Bainite block: Average aspect ratio R1 of second surface layer area [—] | Bainite block: Third surface layer area 20/R1 [μm] | Bainite block: Average grain size $P_{S3}$ of third surface layer area [μm] | Bainite block: Average grain size $P_{C3}$ of third center portion [μm] | $P_{S3}/P_{C3}$ [—] |
|---|---|---|---|---|---|---|---|---|---|---|
| 107 | 9.0 | 57 | 41.5 | F, P | 6.5 | 1.4 | 14.3 | 10.9 | 12.6 | 0.87 |
| 108 | 9.0 | 52 | 43.8 | F, P | 6.4 | 1.5 | 13.3 | 9.1 | 11.3 | 0.81 |
| 109 | 8.0 | 62 | 49.0 | F, P | 5.6 | 1.8 | 11.1 | 8.6 | 11.2 | 0.77 |
| 110 | 8.0 | 53 | 49.0 | P, F | 13.0 | 1.3 | 15.4 | 10.5 | 12.8 | 0.82 |
| 111 | 8.0 | 82 | 49.0 | P | 5.8 | 1.7 | 11.8 | 12.0 | 10.8 | 1.11 |
| 112 | 8.0 | 81 | 51.3 | P | 5.5 | 1.7 | 11.8 | 10.2 | 13.8 | 0.74 |
| 113 | — | It was not possible to manufacture steel wire due to breaking at the time of drawing. | | | | | | | | |
| 114 | 8.0 | 58 | 51.3 | P, F | 8.6 | 1.8 | 11.1 | 11.5 | 13.8 | 0.83 |
| 115 | 8.0 | 100 | 51.3 | — | 10.0 | 1.3 | 15.4 | 17.4 | 15.6 | 1.12 |
| 116 | 8.0 | 78 | 49.8 | F, P | 4.4 | 1.9 | 10.5 | 8.9 | 11.9 | 0.75 |
| 117 | 9.0 | 77 | 58.8 | F, P | 5.4 | 1.5 | 13.3 | 11.5 | 16.1 | 0.71 |
| 118 | 8.0 | 38 | 40.8 | F, P | 9.4 | 1.7 | 11.8 | 11.9 | 13.7 | 0.87 |
| 119 | 8.0 | 96 | 41.5 | F | 4.8 | 2.2 | 9.1 | 8.4 | 9.9 | 0.85 |
| 120 | — | It was not possible to manufacture steel wire due to breaking at the time of drawing. | | | | | | | | |
| 121 | 8.0 | 79 | 41.5 | P, F | 3.3 | 2.7 | 7.4 | 6.8 | 8.8 | 0.77 |
| 122 | 6.0 | 78 | 44.5 | P, F | 2.4 | 3.1 | 6.5 | 6.1 | 7.6 | 0.81 |
| 123 | 6.0 | 82 | 49.8 | P, F | 2.8 | 2.9 | 6.9 | 5.9 | 6.6 | 0.89 |
| 124 | 6.0 | 71 | 49.8 | P, F | 8.3 | 3.2 | 6.3 | 6.4 | 7.4 | 0.84 |
| 125 | 6.0 | 91 | 49.8 | F | 3.8 | 3.5 | 5.7 | 5.9 | 5.2 | 1.13 |
| 126 | 8.0 | 97 | 52.0 | F | 4.0 | 1.9 | 10.5 | 9.2 | 11.2 | 0.82 |
| 127 | 8.0 | 70 | 52.0 | F, P | 8.2 | 2.0 | 10.0 | 9.9 | 11.0 | 0.90 |
| 128 | 14.7 | 100 | 52.0 | — | 7.0 | 1.3 | 15.4 | 13.9 | 14.0 | 0.99 |
| 129 | 6.0 | 88 | 57.3 | P, F | 3.5 | 2.6 | 7.7 | 7.1 | 7.7 | 0.92 |
| 130 | 8.0 | 86 | 59.5 | P, F | 4.4 | 2.2 | 9.1 | 8.3 | 8.7 | 0.95 |
| 131 | 8.0 | 87 | 61.8 | P | 4.2 | 2.3 | 8.7 | 7.7 | 8.9 | 0.87 |
| 132 | 8.0 | 100 | 63.3 | — | 4.5 | 1.8 | 11.1 | 10.2 | 12.9 | 0.79 |
| 133 | 6.0 | 89 | 69.3 | P, F | 3.5 | 2.8 | 7.1 | 6.4 | 7.5 | 0.85 |
| 134 | 6.0 | 90 | 72.3 | P, F | 3.2 | 3.0 | 6.7 | 5.2 | 6.3 | 0.83 |
| 135 | 8.0 | 100 | 72.3 | — | 4.9 | 1.9 | 10.5 | 9.9 | 11.1 | 0.89 |
| 136 | 6.0 | 54 | 56.5 | P, F | 4.3 | 2.9 | 6.9 | 7.1 | 8.2 | 0.87 |
| 137 | — | It was not possible to manufacture steel wire due to breaking at the time of drawing. | | | | | | | | |
| 138 | — | It was not possible to manufacture steel wire due to breaking at the time of drawing. | | | | | | | | |
| 139 | — | It was not possible to manufacture steel wire due to breaking at the time of drawing. | | | | | | | | |
| 140 | — | It was not possible to manufacture steel wire due to breaking at the time of drawing. | | | | | | | | |
| 141 | — | It was not possible to manufacture steel wire due to breaking at the time of drawing. | | | | | | | | |
| 142 | 9.0 | 78 | 58.8 | F, P | 14.8 | 1.1 | 18.2 | 12.1 | 16.3 | 0.74 |

*1(Expression 1) 75 × [C %] + 25

*2P (pearlite), F (ferrite), and M (martensite)

TABLE 2-3

| Steel wire No. | Properties of wire rod: Reduction area [%] | Properties of wire rod: Existence of breaking [—] | Properties of wire rod: Drawability [—] | Properties of wire rod: Remarks | Properties of steel wire: Tensile strength [MPa] | Properties of steel wire: Deformation resistance [MPa] | Properties of steel wire: Marginal compression ratio [%] | Cold workability: Deformation resistance [—] | Cold workability: Marginal compression ratio [—] | Cold workability: Remarks |
|---|---|---|---|---|---|---|---|---|---|---|
| 101 | 28.4 | Absence | Good | Example | 856 | 825 | 78 | Good | Good | Example |
| 102 | 28.4 | Absence | Good | Comparative Example | 819 | 804 | 66 | Good | Poor | Comparative Example |
| 103 | 62.1 | Absence | Good | Example | 1028 | 981 | Greater than or equal to 80 | Good | Good | Example |
| 104 | 62.1 | Absence | Good | Example | 1044 | 997 | Greater than or equal to 80 | Good | Good | Example |
| 105 | — | Presence | Poor | Comparative Example | It was not possible to manufacture steel wire due to breaking at the time of drawing. | | | | | — |
| 106 | 52.1 | Absence | Good | Example | 980 | 978 | Greater than or equal to 80 | Good | Good | Example |
| 107 | 52.1 | Absence | Good | Example | 981 | 971 | Greater than or equal to 80 | Good | Good | Example |
| 108 | 52.1 | Absence | Good | Example | 979 | 971 | Greater than or equal to 80 | Good | Good | Example |

TABLE 2-3-continued

| | Properties of wire rod | | | | Properties of steel wire | | | | | |
|---|---|---|---|---|---|---|---|---|---|---|
| | | | | | | | | Cold workability | | |
| Steel wire No. | Reduction area [%] | Existence of breaking [—] | Drawability [—] | Remarks | Tensile strength [MPa] | Deformation resistance [MPa] | Marginal compression ratio [%] | Deformation resistance [—] | Marginal compression ratio [—] | Remarks |
| 109 | 62.1 | Absence | Good | Example | 1052 | 999 | Greater than or equal to 80 | Good | Good | Example |
| 110 | 62.1 | Absence | Good | Comparative Example | 1009 | 962 | 68 | Good | Poor | Comparative Example |
| 111 | 62.1 | Absence | Good | Comparative Example | 1066 | 1018 | 68 | Good | Poor | Comparative Example |
| 112 | 62.1 | Absence | Good | Example | 1165 | 1081 | 78 | Good | Good | Example |
| 113 | — | Presence | Poor | Comparative Example | It was not possible to manufacture steel wire due to breaking at the time of drawing. | | | | | — |
| 114 | 62.1 | Absence | Good | Comparative Example | 1166 | 1073 | 66 | Good | Poor | Comparative Example |
| 115 | 62.1 | Absence | Good | Comparative Example | 1187 | 1202 | 68 | Poor | Poor | Comparative Example |
| 116 | 62.1 | Absence | Good | Example | 1156 | 1072 | 76 | Good | Good | Example |
| 117 | 52.1 | Absence | Good | Example | 1117 | 1075 | 76 | Good | Good | Example |
| 118 | 62.1 | Absence | Good | Comparative Example | 1040 | 987 | 68 | Good | Poor | Comparative Example |
| 119 | 75.0 | Absence | Good | Example | 1339 | 1072 | 68 | Good | Good | Example |
| 120 | — | Presence | Poor | Comparative Example | It was not possible to manufacture steel wire due to breaking at the time of drawing. | | | | | — |
| 121 | 75.0 | Absence | Good | Example | 1348 | 1067 | 64 | Good | Good | Example |
| 122 | 85.9 | Absence | Good | Example | 1262 | 954 | 68 | Good | Good | Example |
| 123 | 85.9 | Absence | Good | Example | 1398 | 1083 | 66 | Good | Good | Example |
| 124 | 85.9 | Absence | Good | Comparative Example | 1345 | 1049 | 56 | Good | Poor | Comparative Example |
| 125 | 85.9 | Absence | Good | Comparative Example | 1417 | 1097 | 58 | Good | Poor | Comparative Example |
| 126 | 75.0 | Absence | Good | Example | 1358 | 1108 | 66 | Good | Good | Example |
| 127 | 75.0 | Absence | Good | Comparative Example | 1290 | 1086 | 58 | Good | Poor | Comparative Example |
| 128 | 15.6 | Absence | Good | Comparative Example | 1289 | 1324 | 46 | Poor | Poor | Comparative Example |
| 129 | 85.9 | Absence | Good | Example | 1369 | 1068 | 70 | Good | Good | Example |
| 130 | 75.0 | Absence | Good | Example | 1348 | 1097 | 66 | Good | Good | Example |
| 131 | 75.0 | Absence | Good | Example | 1359 | 1092 | 66 | Good | Good | Example |
| 132 | 75.0 | Absence | Good | Example | 1378 | 1087 | 66 | Good | Good | Example |
| 133 | 85.9 | Absence | Good | Example | 1389 | 1063 | 68 | Good | Good | Example |
| 134 | 85.9 | Absence | Good | Example | 1411 | 1076 | 68 | Good | Good | Example |
| 135 | 75.0 | Absence | Good | Example | 1378 | 1089 | 66 | Good | Good | Example |
| 136 | 85.9 | Absence | Good | Comparative Example | 1362 | 1087 | 58 | Good | Poor | Comparative Example |
| 137 | — | Presence | Poor | Comparative Example | It was not possible to manufacture steel wire due to breaking at the time of drawing. | | | | | — |
| 138 | — | Presence | Poor | Comparative Example | It was not possible to manufacture steel wire due to breaking at the time of drawing. | | | | | — |
| 139 | — | Presence | Poor | Comparative Example | It was not possible to manufacture steel wire due to breaking at the time of drawing. | | | | | — |
| 140 | — | Presence | Poor | Comparative Example | It was not possible to manufacture steel wire due to breaking at the time of drawing. | | | | | — |
| 141 | — | Presence | Poor | Comparative Example | It was not possible to manufacture steel wire due to breaking at the time of drawing. | | | | | — |
| 142 | 10.2 | Absence | Good | Comparative Example | 901 | 1011 | 68 | Good | Poor | Comparative Example |

TABLE 3-1

| | | Manufacturing conditions | | Diameter $D_3$ of axis of mechanical part | Structure of axis of mechanical part | | |
|---|---|---|---|---|---|---|---|
| | | | | | Bainite | | |
| | Steel | Heat treatment | | | | Expression (1)*1 | |
| Mechanical part No. | wire No. | Temperature [° C.] | Time [h] | [mm] | [Volume %] | lower limit [Volume %] | Remainder*2 |
| 1001 | 101 | — | — | 11.0 | 45 | 39.3 | F, P |
| 1002 | 102 | — | — | 11.0 | 24 | 39.3 | F, P |

TABLE 3-1-continued

| | | | | | | | |
|---|---|---|---|---|---|---|---|
| 1003 | 103 | 200 | 2.0 | 8.0 | 52 | 39.3 | F, P |
| 1004 | 104 | 250 | 1.0 | 8.0 | 55 | 40.0 | F, P |
| 1006 | 106 | 250 | 1.0 | 9.0 | 54 | 40.8 | F, P |
| 1007 | 107 | 200 | 2.0 | 9.0 | 57 | 41.5 | F, P |
| 1008 | 108 | 300 | 1.0 | 9.0 | 52 | 43.8 | F, P |
| 1009 | 109 | 200 | 1.0 | 8.0 | 62 | 49.0 | F, P |
| 1010 | 110 | 200 | 1.0 | 8.0 | 53 | 49.0 | P, F |
| 1011 | 111 | 200 | 1.0 | 8.0 | 82 | 49.0 | P |
| 1012 | 112 | 350 | 2.0 | 8.0 | 81 | 51.3 | P |
| 1014 | 114 | 350 | 2.0 | 8.0 | 58 | 51.3 | P, F |
| 1015 | 115 | 350 | 2.0 | 8.0 | 100 | 51.3 | — |
| 1016 | 116 | 350 | 1.0 | 8.0 | 78 | 49.8 | F, P |
| 1017 | 117 | 300 | 1.0 | 9.0 | 77 | 58.8 | F, P |
| 1018 | 118 | 300 | 1.0 | 8.0 | 38 | 40.8 | F, P |
| 1019 | 119 | 250 | 2.0 | 8.0 | 96 | 41.5 | F |
| 1021 | 121 | — | — | 8.0 | 79 | 41.5 | P, F |
| 1022 | 122 | 300 | 1.0 | 6.0 | 78 | 44.5 | P, F |
| 1023 | 123 | 250 | 1.0 | 6.0 | 82 | 49.8 | P, F |
| 1024 | 124 | 250 | 1.0 | 6.0 | 71 | 49.8 | P, F |
| 1025 | 125 | 250 | 1.0 | 6.0 | 91 | 49.8 | F |
| 1026 | 126 | 200 | 2.0 | 8.0 | 97 | 52.0 | F |
| 1027 | 127 | 250 | 1.0 | 8.0 | 70 | 52.0 | F, P |
| 1028 | 128 | 200 | 2.0 | 14.7 | 100 | 52.0 | — |
| 1029 | 129 | 300 | 1.0 | 6.0 | 88 | 57.3 | P, F |
| 1030 | 130 | 350 | 1.0 | 8.0 | 86 | 59.5 | P, F |
| 1031 | 131 | 300 | 1.0 | 8.0 | 87 | 61.8 | P |
| 1032 | 132 | 350 | 1.0 | 8.0 | 100 | 63.3 | — |
| 1033 | 133 | 350 | 1.0 | 6.0 | 89 | 69.3 | P, F |
| 1034 | 134 | 300 | 1.0 | 6.0 | 90 | 72.3 | P, F |
| 1035 | 135 | 300 | 1.0 | 8.0 | 100 | 72.3 | — |
| 1036 | 136 | 300 | 1.0 | 6.0 | 54 | 56.5 | P, F |
| 1042 | 142 | 300 | 1.0 | 9.0 | 78 | 58.8 | F, P |

| | Structure of axis of mechanical part Bainite block | | | | | |
|---|---|---|---|---|---|---|
| Mechanical part No. | Standard deviation of grain size [μm] | Average aspect ratio R2 of fourth surface layer area [—] | Fifth surface layer area 20/R2 [μm] | Average grain size $P_{S5}$ of fifth surface layer area [μm] | Average grain size $P_{C5}$ of fifth center portion [μm] | $P_{S5}/P_{C5}$ [—] |
| 1001 | 7.6 | 1.2 | 16.7 | 12.1 | 13.2 | 0.92 |
| 1002 | 10.0 | 1.2 | 17.2 | 12.6 | 15.2 | 0.83 |
| 1003 | 5.7 | 1.7 | 12.0 | 9.4 | 13.2 | 0.71 |
| 1004 | 6.3 | 1.8 | 11.2 | 10.4 | 11.9 | 0.87 |
| 1006 | 5.5 | 1.6 | 12.3 | 10.1 | 14.2 | 0.71 |
| 1007 | 6.5 | 1.4 | 14.4 | 11.1 | 12.5 | 0.89 |
| 1008 | 6.4 | 1.5 | 13.4 | 9.3 | 11.0 | 0.85 |
| 1009 | 5.5 | 1.9 | 10.7 | 8.7 | 11.4 | 0.76 |
| 1010 | 13.2 | 1.3 | 15.5 | 10.5 | 12.5 | 0.84 |
| 1011 | 5.9 | 1.5 | 13.0 | 11.7 | 11.0 | 1.06 |
| 1012 | 5.5 | 1.7 | 11.8 | 10.2 | 13.4 | 0.76 |
| 1014 | 8.6 | 1.8 | 11.2 | 11.4 | 13.5 | 0.84 |
| 1015 | 10.2 | 1.4 | 14.2 | 17.1 | 15.7 | 1.09 |
| 1016 | 4.4 | 2.1 | 9.6 | 8.4 | 11.7 | 0.72 |
| 1017 | 5.5 | 1.5 | 13.0 | 11.2 | 16.6 | 0.67 |
| 1018 | 9.5 | 1.6 | 12.6 | 12.2 | 13.8 | 0.88 |
| 1019 | 5.0 | 2.3 | 8.9 | 8.7 | 10.0 | 0.87 |
| 1021 | 3.4 | 2.6 | 7.8 | 6.8 | 8.9 | 0.76 |
| 1022 | 2.3 | 3.1 | 6.5 | 6.5 | 7.6 | 0.86 |
| 1023 | 3.0 | 2.8 | 7.2 | 6.4 | 6.8 | 0.94 |
| 1024 | 8.0 | 3.4 | 5.9 | 6.2 | 7.2 | 0.86 |
| 1025 | 3.9 | 3.4 | 6.0 | 6.2 | 5.4 | 1.15 |
| 1026 | 3.9 | 2.0 | 10.0 | 9.3 | 11.6 | 0.80 |
| 1027 | 8.1 | 2.2 | 9.3 | 10.1 | 11.3 | 0.89 |
| 1028 | 7.2 | 1.3 | 15.7 | 14.2 | 14.1 | 1.01 |
| 1029 | 3.5 | 2.8 | 7.2 | 6.8 | 7.2 | 0.94 |
| 1030 | 4.6 | 2.0 | 9.9 | 8.4 | 8.9 | 0.94 |
| 1031 | 4.0 | 2.4 | 8.2 | 7.3 | 8.9 | 0.83 |
| 1032 | 4.5 | 1.9 | 10.3 | 10.2 | 12.5 | 0.83 |
| 1033 | 3.4 | 2.8 | 7.0 | 6.4 | 7.9 | 0.81 |
| 1034 | 3.3 | 2.9 | 6.9 | 4.7 | 6.6 | 0.71 |
| 1035 | 5.0 | 1.8 | 11.0 | 9.6 | 11.3 | 0.85 |

TABLE 3-1-continued

| | | | | | | |
|---|---|---|---|---|---|---|
| 1036 | 4.3 | 3.0 | 6.6 | 7.4 | 7.7 | 0.96 |
| 1042 | 14.9 | 1.1 | 18.2 | 12.2 | 16.1 | 0.76 |

*1(Expression 1) 75 × [C %] + 25

*2P (pearlite), F (ferrite), and M (martensite)

TABLE 3-2

| Mechanical part No. | Properties of mechanical part: Tensile strength [MPa] | Evaluation of hydrogen embrittlement resistance [—] | Existence of cracking [—] | Remarks |
|---|---|---|---|---|
| 1001 | 861 | Good | Absence | Example |
| 1002 | 821 | Good | Presence | Comparative Example |
| 1003 | 1033 | Good | Absence | Example |
| 1004 | 1049 | Good | Absence | Example |
| 1006 | 973 | Good | Absence | Example |
| 1007 | 979 | Good | Absence | Example |
| 1008 | 984 | Good | Absence | Example |
| 1009 | 1059 | Good | Absence | Example |
| 1010 | 1012 | Poor | Presence | Comparative Example |
| 1011 | 1072 | Good | Presence | Comparative Example |
| 1012 | 1160 | Good | Absence | Example |
| 1014 | 1162 | Poor | Presence | Comparative Example |
| 1015 | 1191 | Poor | Presence | Comparative Example |
| 1016 | 1158 | Good | Absence | Example |
| 1017 | 1120 | Good | Absence | Example |
| 1018 | 1042 | Good | Presence | Comparative Example |
| 1019 | 1341 | Good | Absence | Example |
| 1021 | 1359 | Good | Absence | Example |
| 1022 | 1269 | Good | Absence | Example |
| 1023 | 1409 | Good | Absence | Example |
| 1024 | 1354 | Good | Presence | Comparative Example |
| 1025 | 1425 | Good | Presence | Comparative Example |
| 1026 | 1362 | Good | Absence | Example |
| 1027 | 1297 | Good | Presence | Comparative Example |
| 1028 | 1297 | Poor | Presence | Comparative Example |
| 1029 | 1373 | Good | Absence | Example |
| 1030 | 1355 | Good | Absence | Example |
| 1031 | 1364 | Good | Absence | Example |
| 1032 | 1386 | Good | Absence | Example |
| 1033 | 1397 | Good | Absence | Example |
| 1034 | 1422 | Good | Absence | Example |
| 1035 | 1384 | Good | Absence | Example |
| 1036 | 1365 | Good | Presence | Comparative Example |
| 1042 | 941 | Poor | Presence | Comparative Example |

Regarding the steel wire Nos. 105, 113, and 120, the total of the holding time in a molten salt bath was short. As a result, martensite was generated as a remainder other than bainite, and thus it was not possible to manufacture the steel wire due to the breaking at the time of the drawing.

Since the steel wire No. 137 had a small amount of C, and thus the martensite was generated, and thereby it was not possible to manufacture the steel wire due to the breaking at the time of the drawing.

The steel wire No. 138 had a large amount of C, and thus the martensite was generated, and thereby it was not possible to manufacture the steel wire due to the breaking at the time of the drawing.

The steel wire No. 139 had a large amount of Si, and thus the martensite was generated, and thereby it was not possible to manufacture the steel wire due to the breaking at the time of the drawing.

The steel wire No. 140 had a small amount of Mn, and thus the martensite was generated, and thereby it was not possible to manufacture the steel wire due to the breaking at the time of the drawing.

The steel wire No. 141 had a large amount of Mn, and thus the martensite was generated, and thereby it was not possible to manufacture the steel wire due to the breaking at the time of the drawing.

In the steel wire Nos. 102, 110, 111, 114, 115, 118, 124, 125, 127, 128, 136 and 142, in a case where the winding temperature is low, or/and the cooling and the isothermal transformation treatment were not sufficiently performed, and thus it was not possible to satisfy one or more of the above properties.

As a result, although it was possible to obtain the excellent drawability could as the wire rod, it was not possible to obtain the excellent cold workability as the steel wire.

Further, the mechanical part Nos. 1002, 1010, 1011, 1014, 1015, 1018, 1024, 1025, 1027, 1028, 1036, and 1042 manufactured by using the steel wire Nos. 102, 110, 111, 114, 115, 118, 124, 125, 127, 128, 136, and 142 by cold forging was no possible to satisfy one or more of the above properties. As a result, the excellent hydrogen embrittlement resistance was not obtained, and/or the cracking occurred.

INDUSTRIAL APPLICABILITY

As described above, according to the present invention, there are provided the wire rod excellent in the drawability, the steel wire excellent in the cold workability, and the high strength mechanical part having the tensile strength in a range of 800 MPa to 1600 MPa at low cost.

The high strength mechanical part can contribute to weight reduction and miniaturization of vehicle, various industrial machines, and construction parts.

Therefore, the present invention has high applicability in vehicles, various industrial machinery and construction industry, and the contribution to industry is extremely remarkable

BRIEF DESCRIPTION OF THE REFERENCE SYMBOLS

1: CROSS SECTION PERPENDICULAR TO LONGITUDINAL DIRECTION OF WIRE ROD
2: DIAMETER OF WIRE ROD $D_1$
3: CENTER OF CROSS SECTION
4: FIRST SURFACE LAYER AREA
5: FIRST CENTER PORTION
11: CROSS SECTION PARALLEL TO LONGITUDINAL DIRECTION OF STEEL WIRE
12: DIAMETER $D_2$ OF STEEL WIRE
13: CENTER LINE OF CROSS SECTION
14: SECOND SURFACE LAYER AREA
21: CROSS SECTION PERPENDICULAR TO LONGITUDINAL DIRECTION OF STEEL WIRE
23: CENTER OF CROSS SECTION
24: THIRD SURFACE LAYER AREA
25: THIRD CENTER PORTION
31: CROSS SECTION PARALLEL TO LONGITUDINAL DIRECTION OF AXIS OF MECHANICAL PART
32: DIAMETER $D_3$ OF AXIS OF MECHANICAL PART
33: CENTER LINE OF CROSS SECTION

34: FOURTH SURFACE LAYER AREA
41: CROSS SECTION PERPENDICULAR TO LONGITUDINAL DIRECTION OF AXIS OF MECHANICAL PART
43: CENTER OF CROSS SECTION
44: FIFTH SURFACE LAYER AREA
45: FIFTH CENTER PORTION

The invention claimed is:

1. A steel wire for a non heat-treated mechanical part, the steel wire comprising, as a chemical composition, by mass %, C: 0.18% to 0.65%,
Si: 0.05% to 1.5%,
Mn: 0.50% to 2.0%,
Cr: 0% to 1.50%,
Mo: 0% to 0.50%,
Ti: 0% to 0.050%,
Al: 0% to 0.050%,
B: 0% to 0.0050%,
Nb: 0% to 0.050%,
V: 0% to 0.20%,
P: limited to less than or equal to 0.030%,
S: limited to less than or equal to 0.030%,
N: limited to less than or equal to 0.0050%,
O: limited to less than or equal to 0.01%, and
a remainder of Fe and impurities;

wherein a structure includes, by volume %, a bainite of greater than or equal to 75×[C %]+25, and a remainder of one or more of a ferrite and a pearlite when an amount of C is set to [C %] by mass %;

when a diameter of the steel wire is set to $D_2$ mm, an area from a surface of the steel wire to a depth of $0.1\times D_2$ mm toward a center line of a cross section is set as a second surface layer area of the steel wire, and an average aspect ratio of a bainite block in the second surface layer area of the steel wire is set to R1 in the cross section parallel to a longitudinal direction of the steel wire, the R1 is greater than or equal to 1.2;

when the diameter of the steel wire is set to $D_2$ mm, an area from a surface of the steel wire to a depth of $0.1\times D_2$ mm toward a center of a cross section is set as a third surface layer area of the steel wire, an area from the depth of $0.25\times D_2$ mm to the center of the cross section is set as a third center portion of the steel wire, an average grain size of a bainite block in the third surface layer area of the steel wire is set to $P_{S3}$ μm, and an average grain size of a bainite block in the third center portion of the steel wire is set to $P_{C3}$ μm in the cross section perpendicular to the longitudinal direction of the steel wire, the $P_{S3}$ satisfies Expression (c), $$P_{S3} \leq 20/R1 \quad \text{(c)},$$

and the $P_{S3}$ and the $P_{C3}$ satisfy Expression (d), $$P_{S3}/P_{C3} \leq 0.95 \quad \text{(d)};$$

a standard deviation of a grain size of the bainite block in the structure is less than or equal to 8.0 μm; and a tensile strength is in a range of 800 MPa to 1600 MPa.

2. The steel wire for a non heat-treated mechanical part according to claim 1, the steel wire comprising, as the chemical composition, by mass %, C: 0.18% to 0.50%, and
Si: 0.05% to 0.50%.

3. The steel wire for a non heat-treated mechanical part according to claim 1, the steel wire comprising, as the chemical composition, by mass %, C: 0.20% to 0.65%, wherein the structure includes, by volume %, the bainite of greater than or equal to 45×[C %]+50 when the amount of C is set to [C %] by mass %.

4. The steel wire for a non heat-treated mechanical part according to claim 1, the steel wire comprising, as the chemical composition, by mass %, B: less than 0.0005%, wherein F1 obtained by Expression (b) is greater than or equal to 2.0, $$F1 = 0.6\times[C\ \%] - 0.1\times[Si\ \%] + 1.4\times[Mn\ \%] + 1.3\times[Cr\ \%] + 3.7\times[Mo\ \%] \quad \text{(b)},$$

when the amount of C is set to [C %], an amount of Si is set to [Si %], an amount of Mn is set to [Mn %], an amount of Cr is set to [Cr %], and an amount of Mo content is set to [Mo %] by mass %.

5. The steel wire for a non heat-treated mechanical part according to claim wherein the R1 is less than or equal to 2.0.

6. The steel wire for a non heat-treated mechanical part according to claim 1, wherein the structure includes, by volume %, the bainite of greater than or equal to 45×[C %]+50.

7. A wire rod for a non heat-treated mechanical part, the wire rod comprising, as a chemical composition, by mass %, C: 0.18% to 0.65%,
Si: 0.05% to 1.5%,
Mn: 0.50% to 2.0%,
Cr: 0% to 1.50%,
Mo: 0% to 0.50%,
Ti: 0% to 0.050%,
Al: 0% to 0.050%,
B: 0% to 0.0050%,
Nb: 0% to 0.050%,
V: 0% to 0.20%,
P: limited to less than or equal to 0.030%,
S: limited to less than or equal to 0.030%,
N: limited to less than or equal to 0.0050%,
O: limited to less than or equal to 0.01%, and
a remainder of Fe and impurities;

wherein a structure includes, by volume %, a bainite of greater than or equal to 75×[C %]+25, and a remainder of one or more of a ferrite and a pearlite without a martensite when an amount of C is set to [C %] by mass %;

an average grain size of a bainite block of the structure is in a range of 5.0 μm to 20.0 μm, and a standard deviation of a grain size of the bainite block is less than or equal to 15.0 μm; and when a diameter of the wire rod is set to $D_1$ mm, an area from a surface of the wire rod to a depth of $0.1\times D_1$ mm toward a center of a cross section is set as a first surface layer area of the wire rod, an area from the depth of $0.25\times D_1$ mm to the center of the cross section is set as a first center portion of the wire rod, an average grain size of a bainite block in the first surface layer area is $P_{S1}$ μm, and an average grain size of a bainite block in the first center portion is $P_{C1}$ μm in the cross section perpendicular to a longitudinal direction of the wire rod, the $P_{S1}$ and the $P_{C1}$ satisfy Expression (a), $$P_{S1}/P_{C1} \leq 0.95 \quad \text{(a)}.$$

8. The wire rod for a non heat-treated mechanical part according to claim 7, the wire rod comprising, as the chemical composition, by mass %, C: 0.18% to 0.50%, and Si: 0.05% to 0.50%.

9. The wire rod for a non heat-treated mechanical part according to claim 7, the wire rod comprising, as the chemical composition, by mass %, C: 0.20% to 0.65%, wherein the structure includes, by volume %, the bainite of greater than or equal to 45×[C %]+50 when the amount of C is set to [C %] by mass %.

10. A non heat-treated mechanical part having a cylindrical axis, the mechanical part comprising, as a chemical composition, by mass %, C: 0.18% to 0.65%, Si: 0.05% to 1.5%, Mn: 0.50% to 2.0%, Cr: 0% to 1.50%, Mo: 0% to 0.50%, Ti: 0% to 0.050%, Al: 0% to 0.050%, B: 0% to 0.0050%, Nb: 0% to 0.050%, V: 0% to 0.20%, P: less than or equal to 0.030%, S: less than or equal to 0.030%, N: less than or equal to 0.0050%, O: less than or equal to 0.01%, and a remainder of Fe and impurities;

wherein a structure includes, by volume %, a bainite of greater than or equal to 75×[C %]+25, and a remainder of one or more of a ferrite and a pearlite when an amount of C is set to [C %] by mass %;

when a diameter of an axis is set to $D_3$ mm, an area from a surface of the axis to a depth of $0.1\times D_3$ mm toward a center line of a cross section is set as a fourth surface layer area of the mechanical part, and an average aspect ratio of a bainite block in the fourth surface layer area of the mechanical part is set to R2 in the cross section parallel to a longitudinal direction of the axis, the R2 is greater than or equal to 1.2;

when the diameter of the axis is set to $D_3$ mm, an area from a surface of the axis to a depth of $0.1\times D_3$ mm toward a center of a cross section is set as a fifth surface layer area of the mechanical part, an area from the depth of $0.25\times D_3$ mm to the center of the cross section is set as a fifth center portion of the mechanical part, an average grain size of a bainite block in the fifth surface layer area of the mechanical part is set to $P_{S5}$ μm, and an average grain size of a bainite block in the fifth center portion of the mechanical part is set to $P_{C5}$ μm in the cross section perpendicular to the longitudinal direction of the axis, the $P_{S5}$ satisfies Expression (e), $$P_{S5}\leq 20/R2 \quad \text{(e)},$$

and the $P_{S5}$ and the $P_{C5}$ satisfy Expression (f), $$P_{S5}/P_{C5}<0.95 \quad \text{(f)};$$

a standard deviation of a grain size of the bainite block in the structure is less than or equal to 8.0 μm; and a tensile strength is in a range of 800 MPa to 1600 MPa.

11. The non heat-treated mechanical part according to claim 10, wherein the R2 is greater than or equal to 1.5, and the tensile strength is in a range of 1200 MPa to 1600 MPa.

12. The non heat-treated mechanical part according to claim 11, wherein the non heat-treated mechanical part is a bolt.

13. The non heat-treated mechanical part according to claim 10, wherein the non heat-treated mechanical part is a bolt.

14. The non heat-treated mechanical part having a cylindrical axis, the mechanical part comprising, as a chemical composition, by mass %, C: 0.18% to 0.65%, Si: 0.05% to 1.5%, Mn: 0.50% to 2.0%, Cr: 0% to 1.50%, Mo: 0% to 0.50%, Ti: 0% to 0.050%, Al: 0% to 0.050%, B: 0% to 0.0050%, Nb: 0% to 0.050%, V: 0% to 0.20%, P: less than or equal to 0.030%, S: less than or equal to 0.030%, N: less than or equal to 0.0050%, O: less than or equal to 0.01%, and a remainder of Fe and impurities;

wherein a structure includes, by volume %, a bainite of greater than or equal to 75×[C %]+25, and a remainder of one or more of a ferrite and a pearlite when an amount of C is set to [C %] by mass %;

when a diameter of an axis is set to $D_3$ mm, an area from a surface of the axis to a depth of $0.1\times D_3$ mm toward a center line of a cross section is set as a fourth surface layer area of the mechanical part, and an average aspect ratio of a bainite block in the fourth surface layer area of the mechanical part is set to R2 in the cross section parallel to a longitudinal direction of the axis, the R2 is greater than or equal to 1.2;

when the diameter of the axis is set to $D_3$ mm, an area from a surface of the axis to a depth of $0.1\times D_3$ mm toward a center of a cross section is set as a fifth surface layer area of the mechanical part, an area from the depth of $0.25\times D_3$ mm to the center of the cross section is set as a fifth center portion of the mechanical part, an average grain size of a bainite block in the fifth surface layer area of the mechanical part is set to $P_{S5}$ μm, and an average grain size of a bainite block in the fifth center portion of the mechanical part is set to $P_{c5}$ μm in the cross section perpendicular to the longitudinal direction of the axis, the $P_{S5}$ satisfies Expression (e), $$P_{S5}\leq 20/R2 \quad \text{(e)},$$

and the $P_{S5}$ and the $P_{C5}$ satisfy Expression (f), $$P_{S5}/P_{C5}\leq 0.95 \quad \text{(f)};$$

a standard deviation of a grain size of the bainite block in the structure is less than or equal to 8.0 μm; and a tensile strength is in a range of 800 MPa to 1600 MPa, which is obtained by performing a cold working on the steel wire according to claim 1.

15. The non heat-treated mechanical part according to claim 14, wherein the $D_2$ and the $D_3$ are equivalent to each other.

16. The non heat-treated mechanical part according to claim 15, wherein the non heat-treated mechanical part is a bolt.

17. The non heat-treated mechanical part according to claim 14, wherein the R2 is greater than or equal to 1.5, and the tensile strength is in a range of 1200 MPa to 1600 MPa.

18. The non heat-treated mechanical part according to claim 17, wherein the non heat-treated mechanical part is a bolt.

19. The non heat-treated mechanical part according to claim 14, wherein the non heat-treated mechanical part is a bolt.

* * * * *